US006002904A

United States Patent [19]

Yoshida et al.

[11] Patent Number: 6,002,904

[45] **Date of Patent: *Dec. 14, 1999**

[54] IMAGE FORMING APPARATUS HAVING LIGHT PROJECTING UNIT FOR PROJECTING LIGHT ON IMAGE CARRIER PRIOR TO TRANSFER OF TONER IMAGE

[75] Inventors: Seiichi Yoshida; Fumio Shimazu, both of Nara; Hideki Ohnishi, Chiba, all of Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/976,249

[22] Filed: Nov. 21, 1997

[30] Foreign Application Priority Data

Nov. 21, 1996 [JP] Japan ..... 8-311113

[51] Int. Cl.[6] ..... G03G 15/01

[52] U.S. Cl. ..... 399/296; 399/28; 399/32

[58] Field of Search ..... 399/27, 28, 32, 399/39, 48, 49, 56, 296, 302, 303, 308, 223

[56] References Cited

U.S. PATENT DOCUMENTS

| | | | |
|---|---|---|---|
| 4,427,755 | 1/1984 | Tokunaga et al. . | |
| 4,669,854 | 6/1987 | Ichikawa et al. | 399/296 |
| 5,351,113 | 9/1994 | Pietrowski et al. | 399/296 |
| 5,390,012 | 2/1995 | Miyashiro et al. . | |
| 5,619,308 | 4/1997 | Kinoshita et al. | 399/48 |
| 5,783,343 | 7/1998 | Tombs et al. | 399/298 X |
| 5,799,225 | 8/1998 | Abe et al. | 399/66 |

FOREIGN PATENT DOCUMENTS

| | | |
|---|---|---|
| 1-191168 | 8/1989 | Japan . |
| 1-191169 | 8/1989 | Japan . |
| 1-191172 | 8/1989 | Japan . |
| 1-191174 | 8/1989 | Japan . |
| 1-191175 | 8/1989 | Japan . |
| 1-191176 | 8/1989 | Japan . |
| 1-191177 | 8/1989 | Japan . |
| 2-74975 | 3/1990 | Japan . |

OTHER PUBLICATIONS

Digital Image Processing; Gonzalez, Rafael, Richard Woods, 1992.

*Primary Examiner*—Arthur T. Grimley
*Assistant Examiner*—Quana Grainger

[57] ABSTRACT

An image forming apparatus is provided with a photosensitive drum on whose surface a toner image is formed, and image formation is carried out by transferring the toner image onto a transfer material such as paper or OHP sheet which is caused to electrostatically adhere to a surface of a transfer drum while being guided to the photosensitive drum. Alternatively, the toner image formed on the photosensitive drum may be once transferred onto an intermediate transfer drum, then transferred from the intermediate transfer drum onto the transfer material. In the image forming apparatus, a light projecting device for projecting light onto the photosensitive drum is provided on an upstream side to a toner image transfer position and on a downstream side to a development position on the photosensitive drum. Execution and suspension of the light projecting operation of the light projecting device is controlled depending on a toner type.

18 Claims, 17 Drawing Sheets

IMAGE FORMING APPARATUS HAVING LIGHT PROJECTING UNIT FOR PROJECTING LIGHT ON IMAGE CARRIER PRIOR TO TRANSFER OF TONER IMAGE

FIELD OF THE INVENTION

The present invention relates to an image forming apparatus for use in a laser printer, a copying machine, a laser facsimile machine, a combined machine of these machines, or the like, and particularly relates to an image forming apparatus which forms an image, either (1) by transferring a toner image onto a transfer material which has been electrostatically attracted and held by a transfer material carrier while being guided to an image carrier, or (2) by first transferring a toner image held on the image carrier onto an intermediate transfer body and thereafter transferring it onto the transfer material.

BACKGROUND OF THE INVENTION

Conventionally, there has been an image forming apparatus which develops an image by causing toner to adhere to an electrostatic latent image formed on a photosensitive drum (image carrier) and transfers a resultant toner image onto transfer paper (transfer material) which is caught on a transfer drum (transfer material carrier).

Such an image forming apparatus is arranged, for example, as follows, as illustrated in FIG. 19: a corona charger 102 which attracts a transfer material P, and a corona charger 104 which transfers a toner image formed on a surface of a photosensitive drum 103 onto the transfer material P, are discretely provided inside a transfer drum which is composed of a cylinder 101 covered with a dielectric layer 101*a*, so that the attraction of the transfer material P and the transfer are carried out by the chargers 102 and 104, respectively.

Another image forming apparatus of this type, as illustrated in FIG. 20, has (1) a transfer drum which is a two-layer cylinder 201 composed of an outer semi-conductive layer 201*a* and an inner foundation layer 201*b*, and (2) a grip system 202 for holding, along a circumferential surface of the cylinder 201, a transfer material P which has been transported thereto. This image forming apparatus is arranged so that an edge of the transfer material P thus arriving there is caught by the grip system 202 and is held on the cylinder 201 around its circumferential surface, and thereafter, the surface of the cylinder 201 is charged by applying a voltage to the outer semi-conductive layer 201*a* of the cylinder 201 or causing a charger inside the cylinder 201 to discharge electricity, so that the toner image on the photosensitive drum 103 is transferred onto the transfer material P.

However, the image forming apparatus shown in FIG. 19 has a following problem: since the cylinder 101 has a single-layer structure, equipped with only the dielectric layer 101*a*, the corona chargers 102 and 103 inside the cylinder 101 are indispensable, and as a result this sets a limit to the size of the image forming apparatus when reducing the size is attempted.

In the case of the image forming apparatus shown in FIG. 20, the number of chargers can be decreased since the cylinder 201 has the two-layer structure so that the charging of the cylinder 201 for transferring the toner image onto the transfer material P is facilitated. However, the grip system 202 provided in the image forming apparatus makes the arrangement of the apparatus as a whole complicated, and causes the number of parts used in the apparatus to increase. As a result, a cost for manufacturing the apparatus increases.

Then, as an image forming apparatus which does not have the above problems, the Japanese Publication for Laid-Open Patent Application No. 2-74975/1990 (Tokukaihei 2-74975) discloses an image forming apparatus having (1) a transfer drum composed of a grounded metal roll on which a conductive rubber and a dielectric film are laminated, and (2) a corona charger driven by a unipolar power source, which is provided in the vicinity of a position on the transfer drum where a transfer sheet is separated from the transfer drum.

In the image forming apparatus described above, the transfer sheet is caused to adhere to the transfer drum by inducing charges in the dielectric film with the use of the corona charger. Then, the adhesion of the transfer sheet further causes induction of electric charges, thereby causing transfer.

Therefore, by thus arranging the image forming apparatus, only one charger is required since the charging of the transfer drum surface for adhesion and transfer with respect to the transfer sheet is carried out with the use of the single charger, and the reduction of the transfer drum size can be achieved. Besides, such a system as the aforementioned grip system 202 for holding the transfer sheet is unnecessary. Thus, adhesion of the transfer sheet can be achieved in a simple arrangement.

In the image forming apparatus disclosed by the aforementioned publication, however, the following problem arises. The surface of the transfer drum is charged by atmospheric discharge of the corona charger, and in the case where a color image is formed, that is, in the case where the transfer process is repeatedly carried out several times, electric charges should be supplied by the corona charger every time the transfer process is carried out. Therefore, a charging unit including a unipolar power source or the like for controlling the operation for driving the corona charger is required, and this causes the number of parts constituting the image forming apparatus to increase, thereby resulting in a problem of an increase in the manufacturing cost of the apparatus.

Moreover, if the surface of the transfer drum is scarred, an electric field generated by the atmospheric discharge becomes smaller, and an electric field balance is therefore easily distorted at the scars. Therefore, transfer defects such as voids occur at the scars, and as a result the image quality degrades.

Furthermore, since the surface of the transfer drum is charged by the atmospheric discharge, a high voltage is required for the charging, and as a result energy required for driving the image forming apparatus increases. Besides, since the atmospheric discharge is easily affected by ambient conditions such as humidity of the atmosphere, surface potentials of the transfer drum tend to vary, thereby causing the transfer drum to fail to attract the transfer sheet, and causing distortion of printed pictures and letters.

To solve such problems, the Japanese Publication for Laid-Open Patent Application No. 5-173435/1993 (Tokukaihei 5-173435) proposes a transfer device which has a transfer drum composed of a resilient layer made of an aerated material and a dielectric layer covering the resilient layer, and forms a color image on a transfer material by sequentially transferring uni-color toner images which are sequentially formed on a photosensitive drum, onto the transfer material such as a transfer sheet which adheres to the transfer drum, so that the toner images fall on one another.

In the foregoing transfer device, an attracting roller as charging means is used for causing the transfer material to electrostatically adheres to the transfer drum. Besides, cavities are provided between the resilient layer and the dielectric layer in the transfer drum so that electric charges are accumulated on a reverse surface of the dielectric layer so that ambient conditions may not affect the maintenance of electric charges. By doing so, attracting capacity, that is, an attracting property with respect to the transfer material is improved.

However, as to the arrangement disclosed by Tokukaihei 5-173435, the publication does not particularly specifies a hardness of the aerated layer and a contact pressure (nip pressure) exerted between the attracting roller and the transfer drum, and besides, has no description on a nip width and a nip period. Therefore, it can be considered that the nip period is not variable.

It is generally known that a quantity of electric charges, which are held during a certain period (nip period) by a transfer material while passing through between the transfer drum and the attracting roller, varies with a type of the transfer material. For this reason, a transfer electric field for electrostatic transfer from the photosensitive drum to the transfer material considerably varies with the type of the transfer material. More specifically, in the case where the nip period is set constant, the quantity of electric charges supplied during the period differ depending on types of transfer materials, and the electrostatic transfer capacity of the transfer drum deteriorates in cases of some types of transfer materials. As a result, in such cases, the toner images formed on the photosensitive drum cannot be electrostatically transferred onto the transfer materials in good conditions.

As already known, during the reversal developing method, toner adheres to exposed portions of the photosensitive drum. Background portions of the photosensitive drum have high potentials even after the development, and a transfer currency is great on the transfer of toner to a transfer material. Therefore, the transfer drum has a great attracting force with respect to the transfer sheet. As a result, in the separation process after the transfer, the toner image which has been transferred onto the transfer sheet becomes unstable, or the toner comes off and discharges electricity, thereby scattering on the transfer sheet.

To solve the above-described problem, removing residual charges in the background portions of the photosensitive drum is attempted by exposing the whole surface of the photosensitive drum before the transfer and after the development, in an arrangement disclosed by the Japanese Publication for Laid-Open Patent Application No. 55-17111/1980 (Tokukaisho 55-17111). By doing so, the potentials of the background portions to which toner adheres are lowered, and as a result it is possible to improve the separating operation. However, this also raises a potential of toner on the photosensitive drum, thereby causing scatter of the toner in a horizontal direction (thrust direction).

Note that the scatter of toner signifies distortion of a toner image on the photosensitive drum which is to be transferred, or distortion of toner images to be thereafter subsequently transferred onto the transfer sheet, which occurs on the transferring occasion. To be more specific, the scatter of toner indicates the following phenomenon: for example, in the case where a letter "I" is transferred, toner scatters around the letter "I" on the transfer sheet, thereby resulting in that the transferred letter becomes thicker than an intended thickness.

The aforementioned phenomenon of the scatter of toner is conspicuous in the case where several color toners are laminated so as to form a color image. For example, in the case where a blue letter is formed, a toner image of cyan which has been first transferred is overlapped by a toner image of magenta. In this case, the toner of magenta sometimes scatters around the toner image of cyan.

In the case where an image is developed at a charge quantity of about 10 to 20 $\mu$C/g in about three layers of toners with the use of toners whose particles have a diameter of about 10 $\mu$m, a potential of one hundred and several tens to three hundred volts is detected on the photosensitive drum. An effective transfer electric field varies by this potential.

The Japanese Publications for Laid-Open Patent Applications No. 1-191168/1989 (Tokukaihei 1-191168), No.1-191169/1989 (Tokukaihei 1-191169), No.1-191172/1989 (Tokukaihei 1-191172), and No.1-191174 to 1-191177/1989 (Tokukaihei 1-191174 to 1-191177) disclose a method of removing charges in the backgrounds of toners by projecting luminous components with wavelengths which pass through the toners. This method is applicable to both the reversal development type and the regular development type. The above publications also examine a method wherein electricity with the same polarity as that of the background potential or a polarity reverse to the background polarity is discharged, and a method for pre-charging toner, as well as a method for controlling a potential of the photosensitive drum.

However, the techniques disclosed by the aforementioned publications are not intended to be applied with respect to a so-called solid transfer body for causing a transfer sheet to adhere to the transfer drum. Therefore, the image forming apparatuses disclosed by the above publications are arranged so that, in the case where a color image is formed, uni-color images are developed on the photosensitive drum so that they overlap each other, and the color toner image thus formed on the photosensitive drum is transferred onto a transfer sheet.

On the other hand, in the case where a solid transfer body is used, or, particularly in the case of transfer by laminating toner images (hereinafter referred to as laminating transfer), the photosensitive drum and a transfer material are brought into contact every time a transfer operation is carried out. Therefore, a surface potential of the transfer material is raised by the background potential of the photosensitive drum, and the effective transfer electric field accordingly becomes smaller, as the transfer operation is repeated twice or three times in the laminating transfer process. This problem stems from that a material of the solid transfer body is a high-resistant material and transmits a small electric currency, thereby having a property of maintaining a potential. An intermediate transfer body made of the same material has the same problem.

Furthermore, the phenomenon that the effective transfer electric field becomes smaller is conspicuous in the case where a transfer material with a high surface resistivity, such as OHP or coated paper, is used. In the case of OHP, a surface potential of OHP on transfer of the second color differs from that on transfer of the first color in a manner such that the transfer electric field lowers by about 300 V to 400 V. For example, in the case where a voltage of 2200 V as a transfer bias voltage for OHP is applied to the solid transfer body, the transfer potential becomes 1500 V on the transfer of the first color since 700 V is lost in attracting OHP. Thereafter, it becomes about 1100 V on the transfer of the second color, and then, becomes about 700 V on the transfer of the third color. Since a lower limit of the transfer potential is found to be 1000 V from experiments, toner of the third color and those which are to be subsequently transferred rather go back to the photosensitive drum side.

SUMMARY OF THE INVENTION

The object of the present invention is to provide an image forming apparatus capable of appropriately controlling a background potential of an image carrier, so as to prevent scatter of toner which occurs on projection of light, prevent an effective transfer electric field from becoming smaller, improve a separation property, and achieve a good image quality.

To achieve the aforementioned object, the image forming apparatus of the present invention is characterized in comprising (1) an image carrier, (2) a developing unit for forming a toner image on the image carrier, (3) a transfer unit for transferring the toner image onto a transfer material, (4) a light projecting unit for projecting light on the image carrier after the toner image is formed thereon, before the transfer of the toner image, and (5) a control unit for judging a type of the toner, and controlling execution and suspension of the light projecting operation by the light projecting unit, depending on the type of the toner.

In the aforementioned arrangement, a toner image formed on the image carrier is transferred onto the transfer material so that an image is formed. Note that on transfer of the toner image onto the transfer material, the transfer material may be caused to electrostatically adhere to the transfer material carrier so as to be guided to the image carrier, or the toner image formed on the image carrier may be once transferred onto the intermediate transfer body, then transferred therefrom onto the transfer material.

In the aforementioned arrangement, by exposing the whole surface of the image carrier after the development of the toner image and before the transfer of the toner image onto the transfer material, residual charges in the toner image background portions on the image carrier are removed. By doing so, a transfer voltage can be decreased, so that the separation property can be improved. However, if the background potential is unconditionally lowered before transfer, a potential of the toner image also rises, causing scatter of the toner before transfer to occur on the image carrier. Besides, in the case where the transfer material is guided by the transfer material carrier to the image carrier as described above, the image carrier and the transfer material come into contact at every transfer operation, causing the surface potential of the transfer material to rise due to the background potential of the image carrier. Therefore, in the case of the laminating transfer with the use of toners of various colors in particular, the effective transfer electric field gradually becomes smaller as the transfer operation is repeated twice, three times, or the like. Therefore, it is preferable that the rise of the surface potential of the transfer material due to the background potential is suppressed.

To achieve this, the image forming apparatus of the present invention is. characterized in comprising the control unit which controls execution and suspension of the light projecting operation by said light projecting unit, depending on the type of the toner.

To be more specific, the aforementioned phenomenon that the potential of the toner image rises as the background potential of the image carrier is lowered conspicuously occurs in the case where a toner having a great conductivity is used. For example, in the case of a black toner in which carbon accounts for a large part, the carbon, which is conductive, is affected by the projected light, thereby causing the potential of the toner image to rise. Therefore, the foregoing phenomenon is not conspicuous in the case of a toner having a small conductivity such as (1) a color toner, (2) a black toner in which carbon accounts for a small part, or (3) a black toner which is processed so as to be non-conductive even though carbon accounts for a large part in it.

Therefore, the background potential can be lowered with the toner image surface potential maintained, by causing the light projecting unit to project light only in the case of a toner having a small conductivity such as (1) a color toner, (2) a black toner in which carbon accounts for a small part, or (3) a black toner which is processed so as to be non-conductive even though carbon accounts for a large part in it.

Thus, by arranging the image forming apparatus so that the background potential of the image carrier is appropriately controlled by light projection, the image forming apparatus is made capable of preventing scatter of toner on the light projection, preventing the lowering of the effective transfer electric field, and improving the separation property, so that good image quality is ensured.

In the present invention, light projection onto said image carrier is carried out only in the case where the toner is a toner whose colorant is not a conductive material.

For a fuller understanding of the nature and advantages of the invention, reference should be made to the ensuing detailed description taken in conjunction with the accompanying drawings.

WIDTH OF CONDUCTIVE LAYER>WIDTH OF SEMI-CONDUCTIVE LAYER>WIDTH OF DIELECTRIC LAYER

Figure 9:
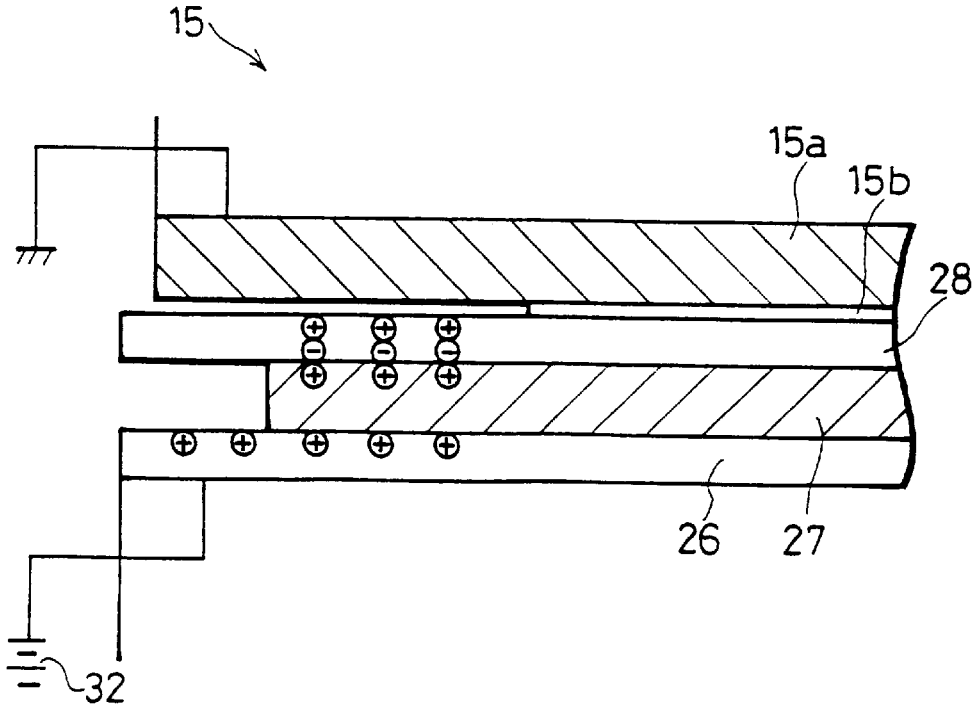

FIG. 9 is a view illustrating a movement of charges between the transfer drum and the photosensitive drum in the case where the widths of layers of the transfer drum satisfy:

WIDTH OF CONDUCTIVE LAYER>WIDTH OF SEMI-CONDUCTIVE LAYER=WIDTH OF DIELECTRIC LAYER

Figure 10:
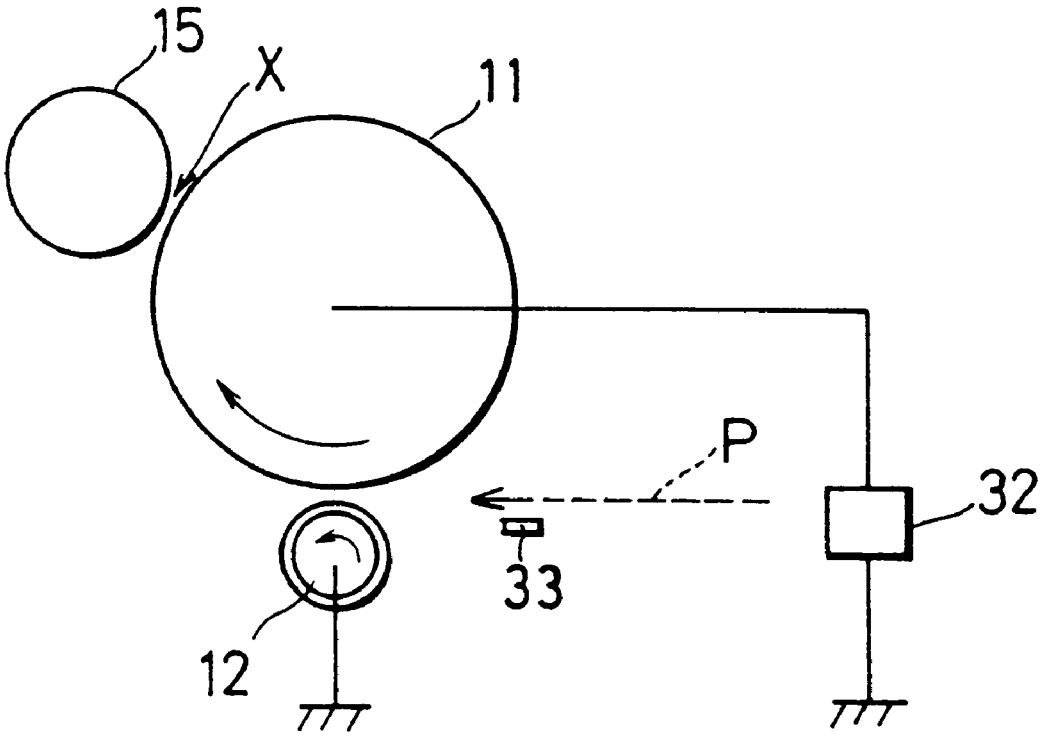

FIG. 10 is a view illustrating an arrangement of a transfer material detecting sensor of the image forming apparatus.

Figure 11:
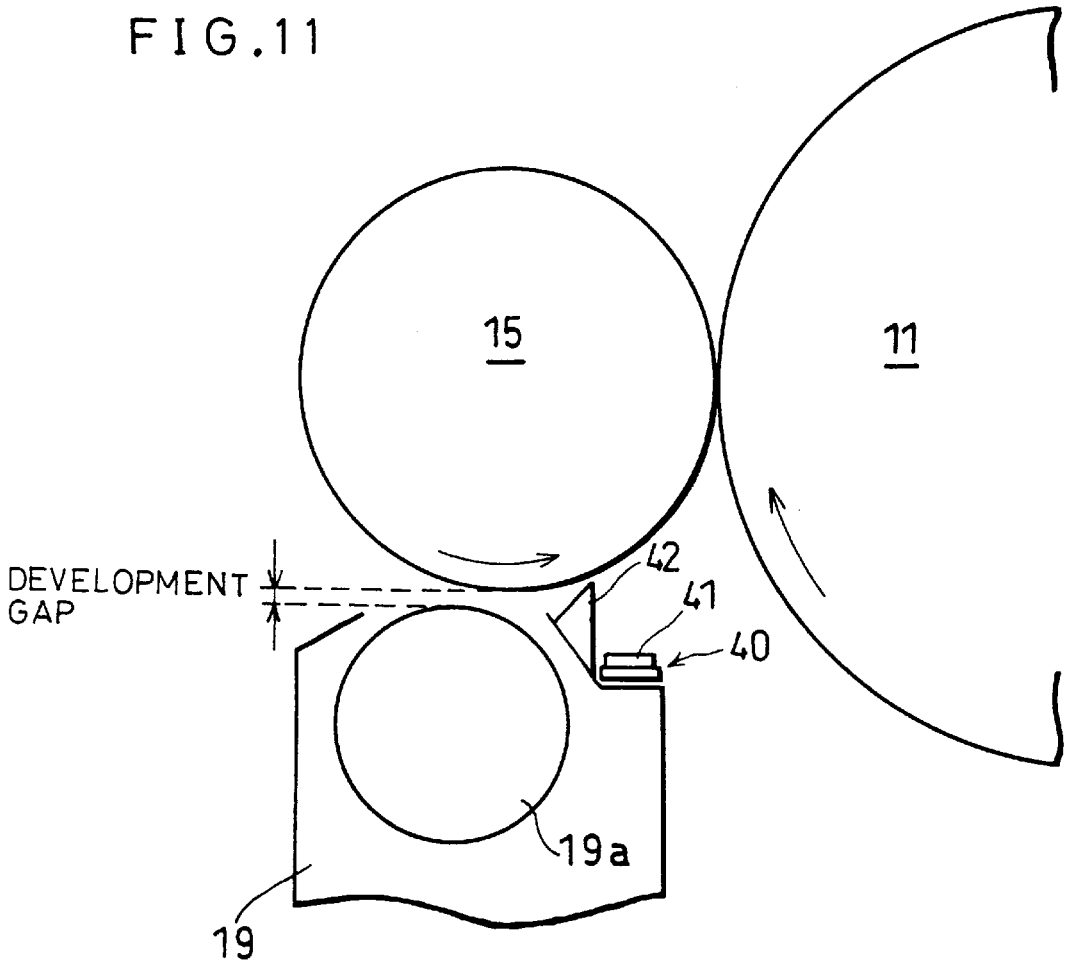

FIG. 11 is a view illustrating a schematic arrangement of a light projecting device of the image forming apparatus.

Figure 12:
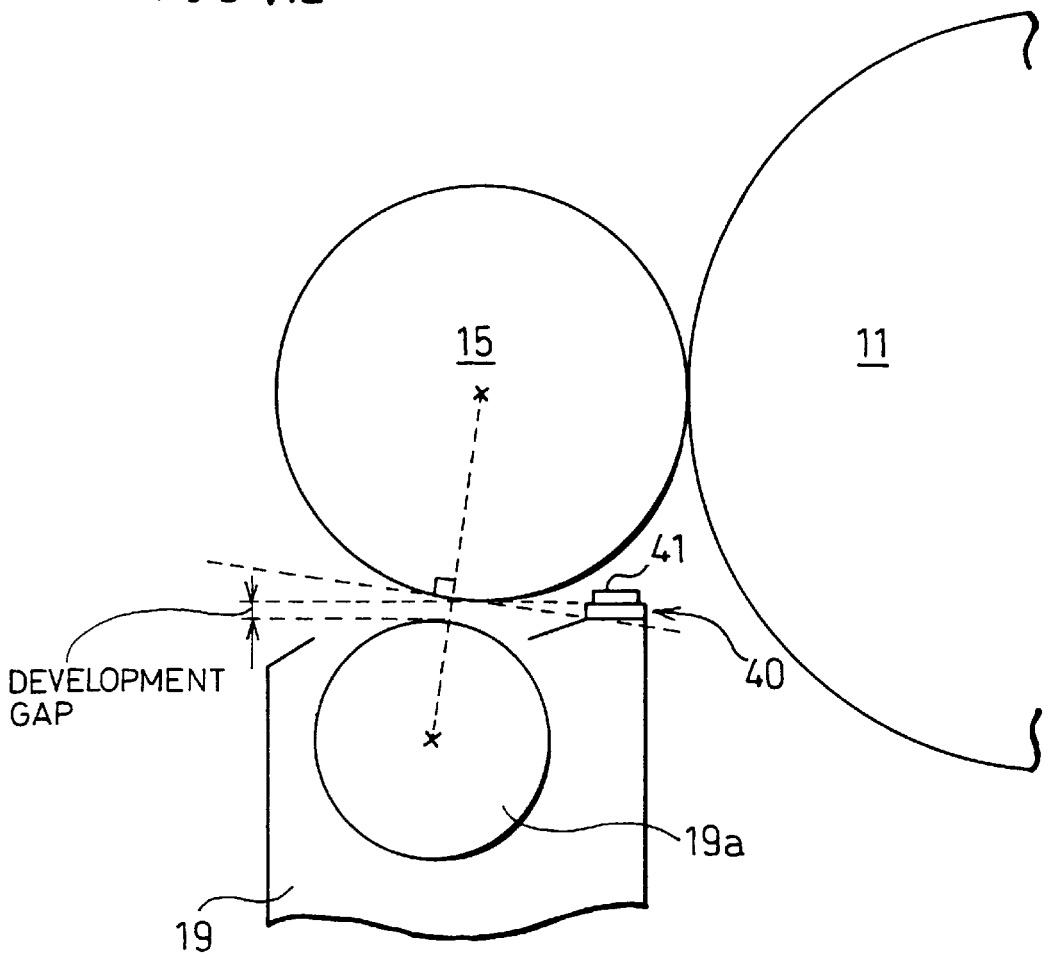

FIG. 12 is a view illustrating a state where an LED array of the light projecting device is provided on an upstream side to a developer sleeve.

Figure 13:
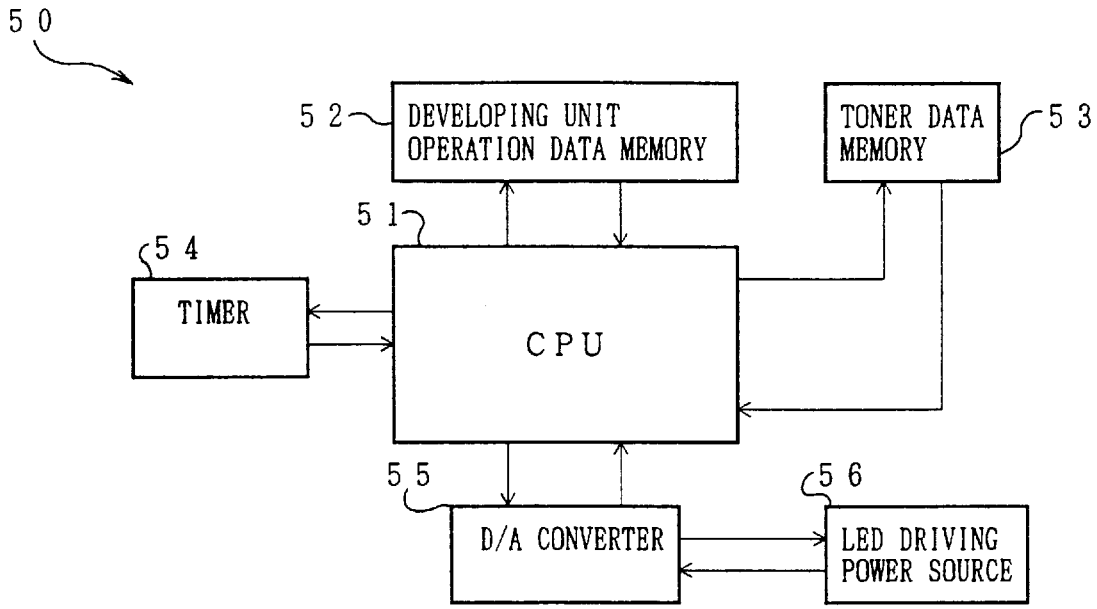

FIG. 13 is a block diagram illustrating an arrangement of a control unit of the light projecting device.

Figure 14:
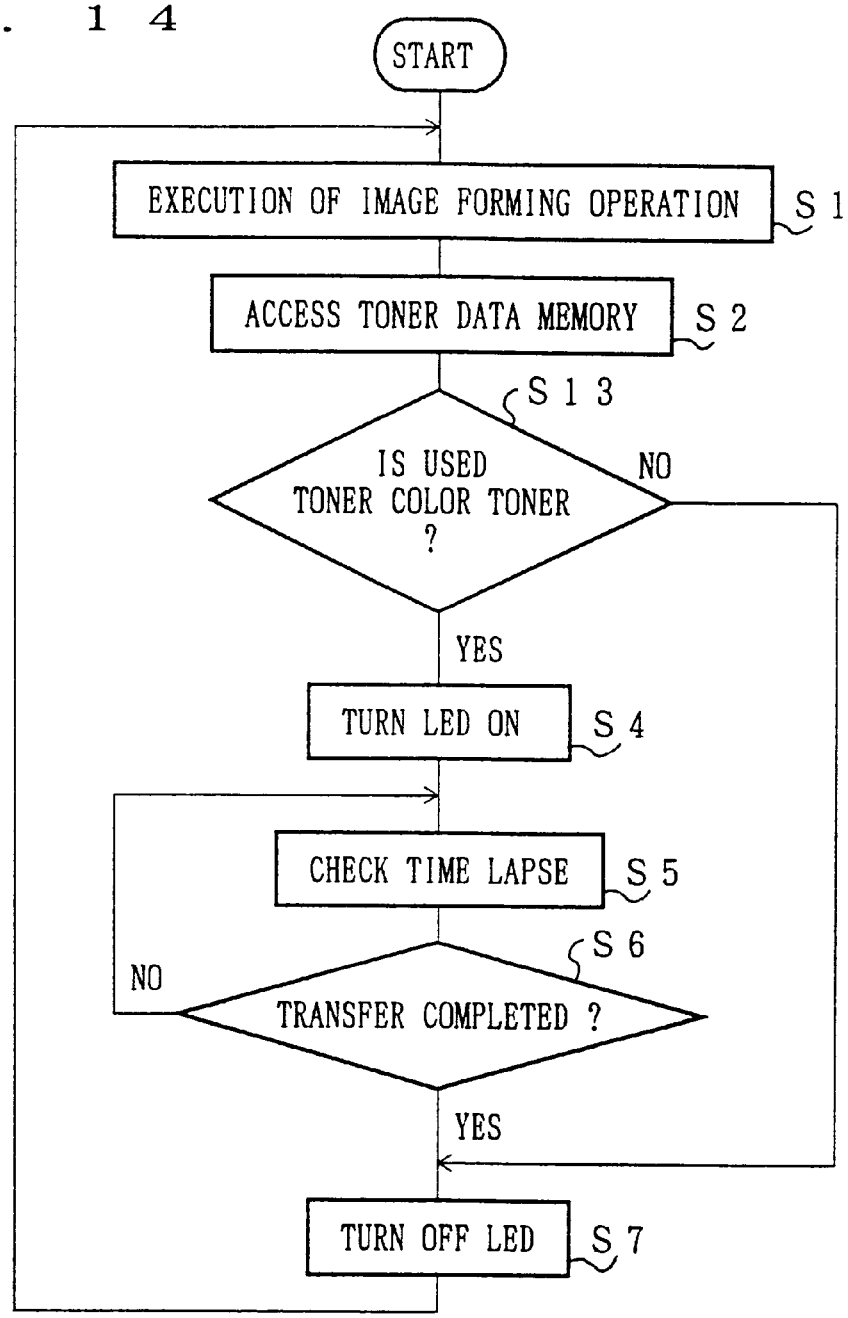

FIG. 14 is a flowchart of a control operation sequence for judging whether or not a used toner is a color toner and turning on/off the LED array, which is conducted by the control unit of the light projecting device.

Figure 15:
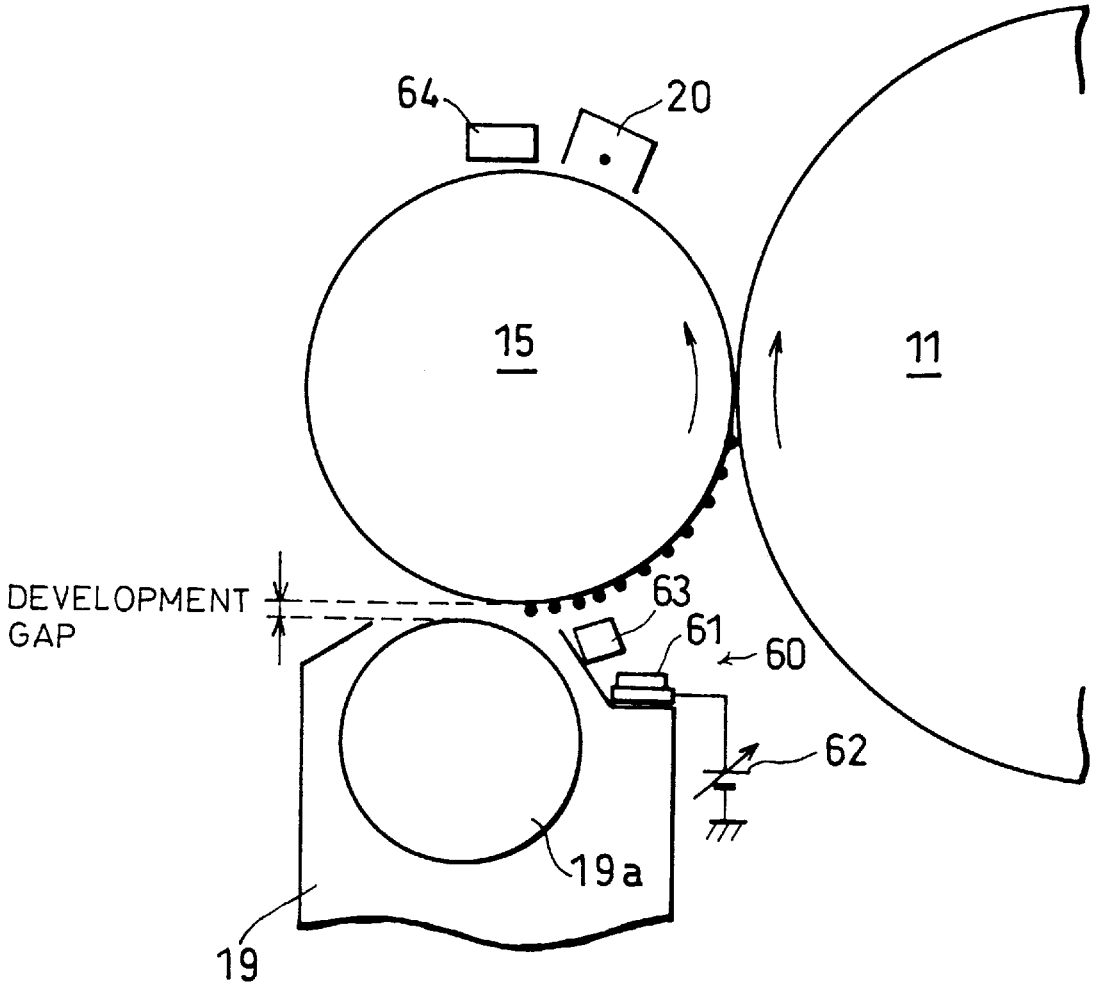

FIG. 15 is an explanatory view illustrating an arrangement of a light projecting device of an image forming apparatus in accordance with another embodiment of the present invention.

Figure 16:
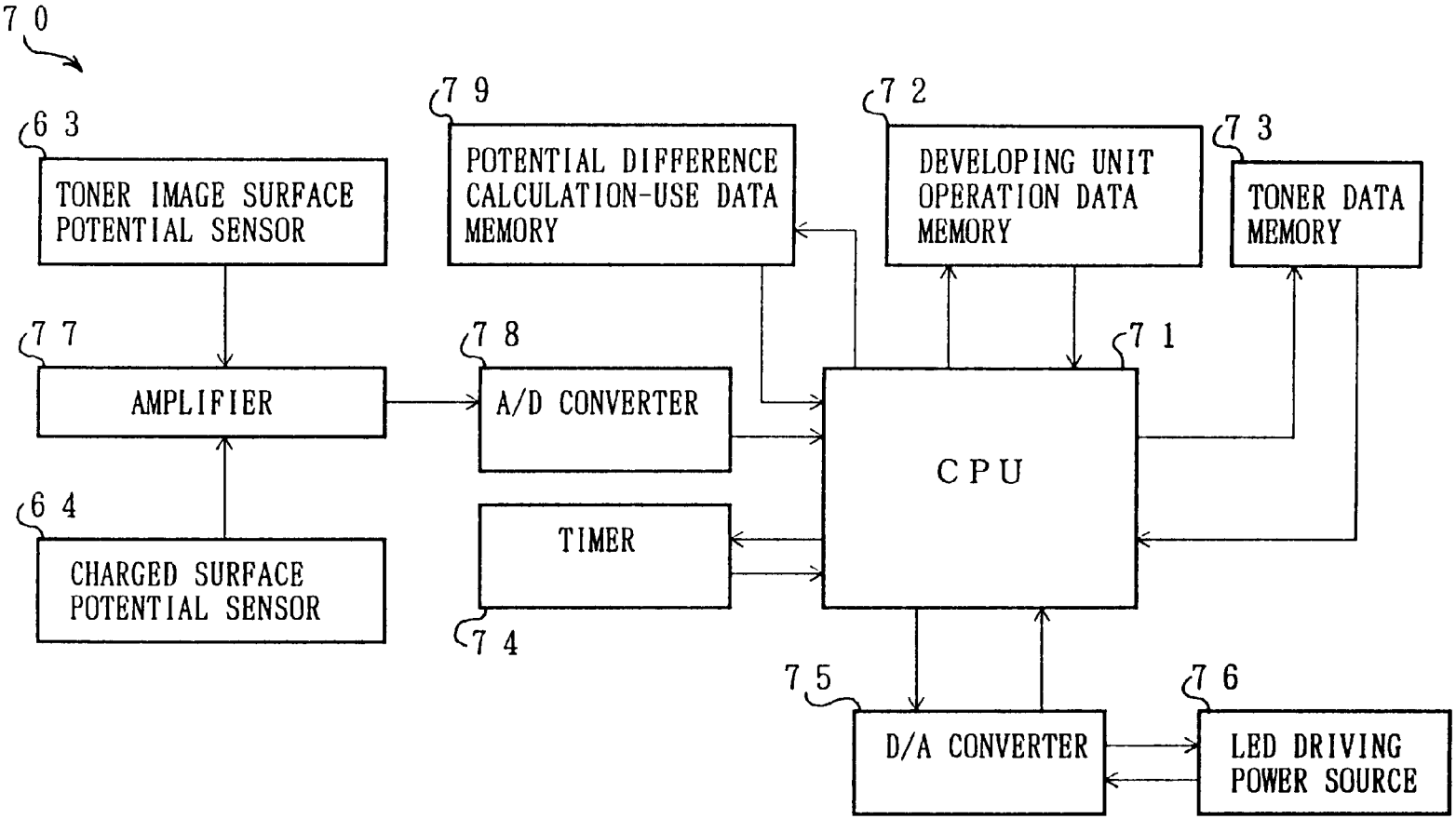

FIG. 16 is a block diagram illustrating an arrangement of a control unit of the light projecting device.

Figure 17:
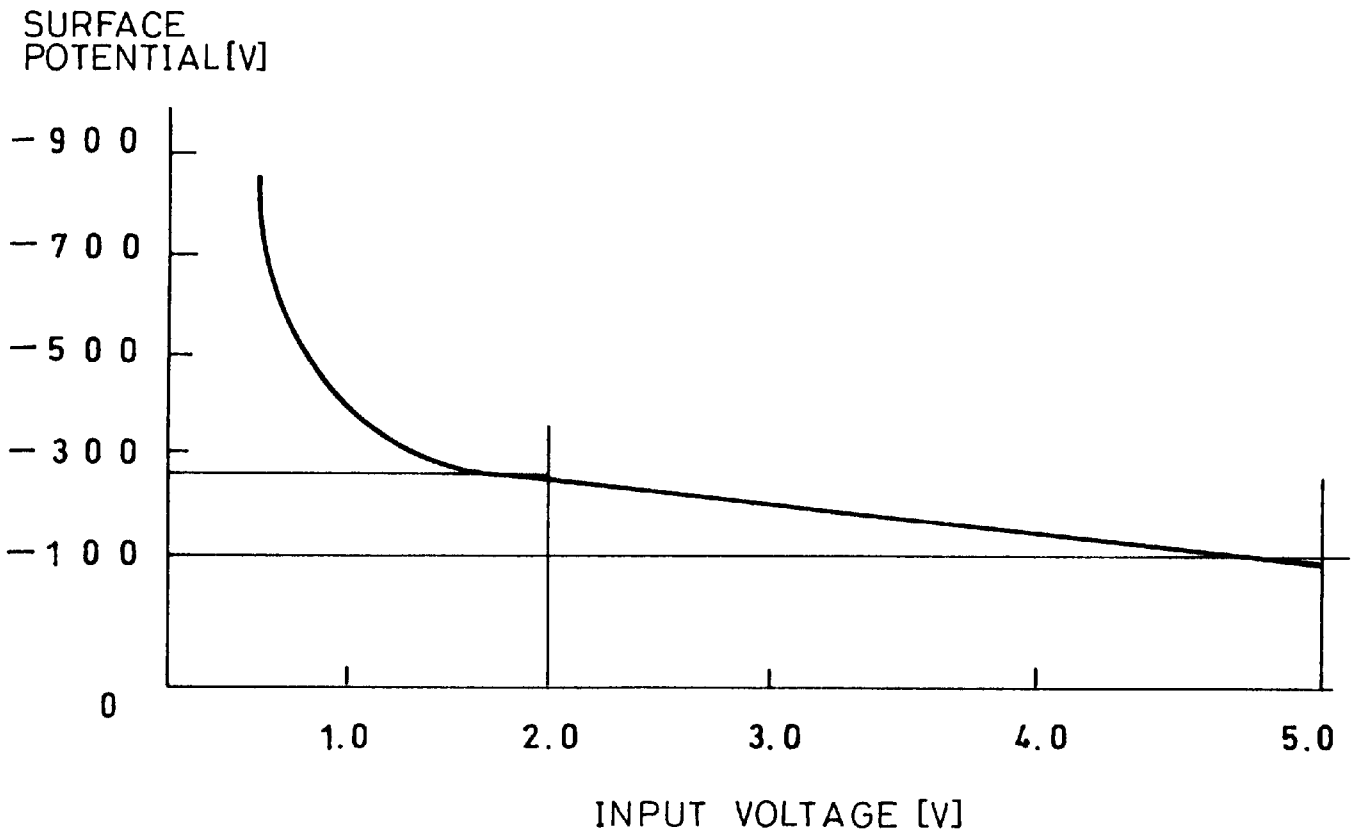

FIG. 17 is an explanatory view illustrating relationship between an input voltage supplied to an LED array of the light projecting device and a surface potential of a photosensitive drum.

Figure 18:
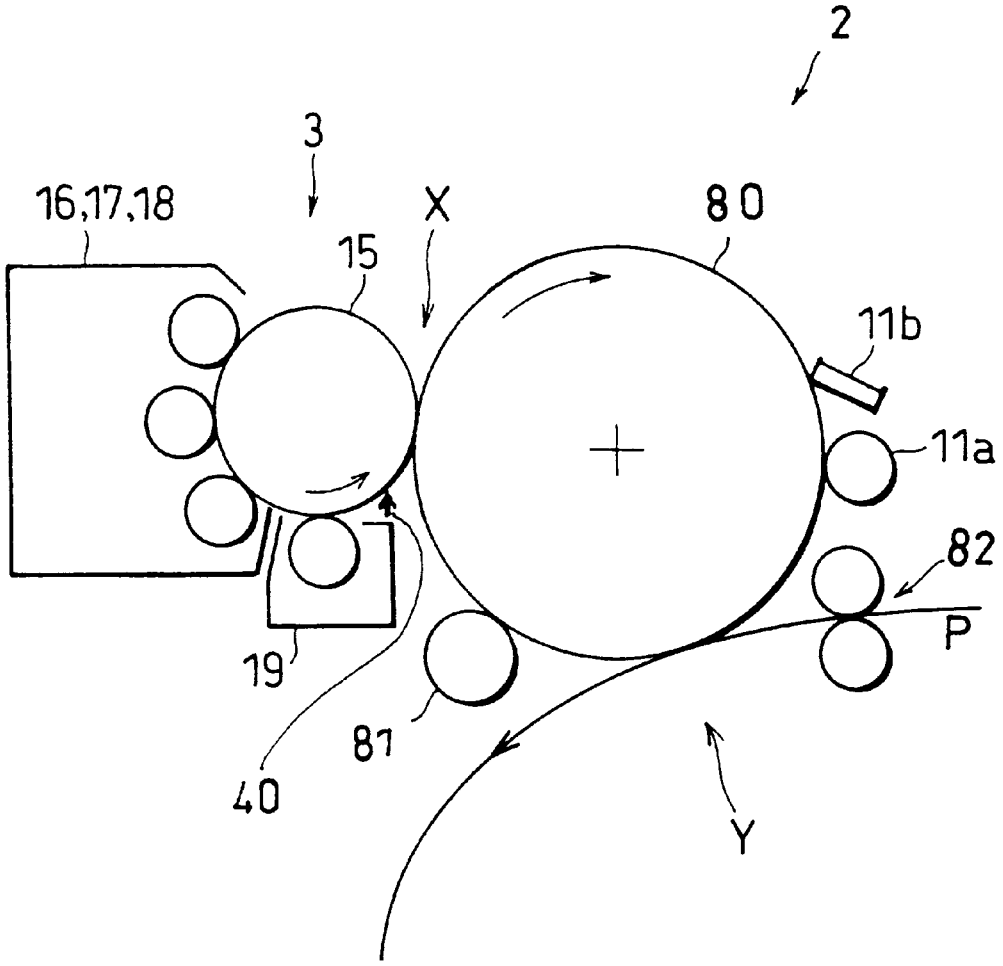

FIG. 18 is a view illustrating an image forming apparatus in accordance with still another embodiment of the present invention wherein an intermediate transfer drum is provided.

Figure 19:
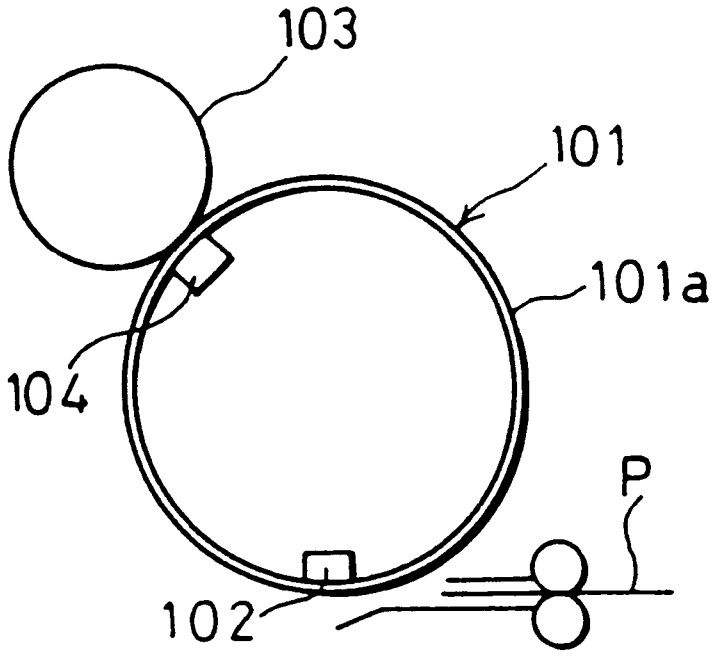
FIG.19 PRIOR ART

FIG. 19 is a view illustrating a schematic arrangement of a conventional image forming apparatus.

Figure 20:
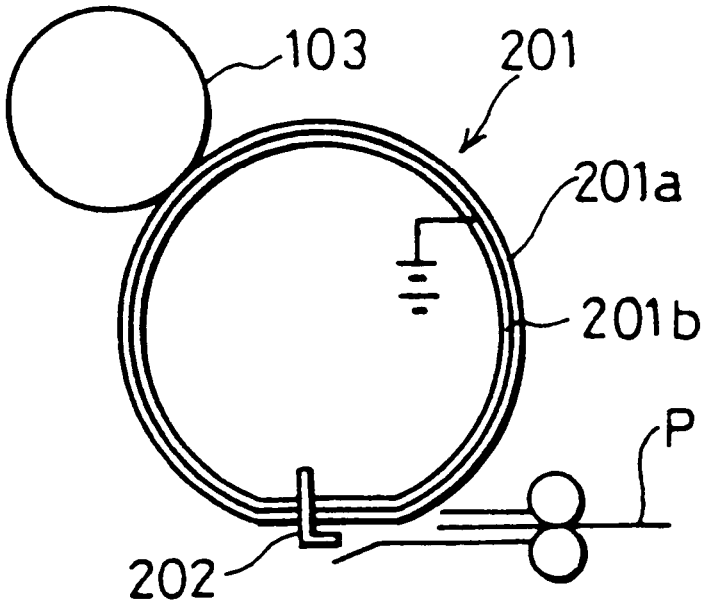
FIG.20 PRIOR ART

FIG. 20 is a view illustrating a schematic arrangement of another conventional image forming apparatus.

DESCRIPTION OF THE PREFERRED EMBODIMENTS

[First Embodiment]

The following description will explain one embodiment of the present invention while referring to FIGS. 1 through 14.

Figure 2:
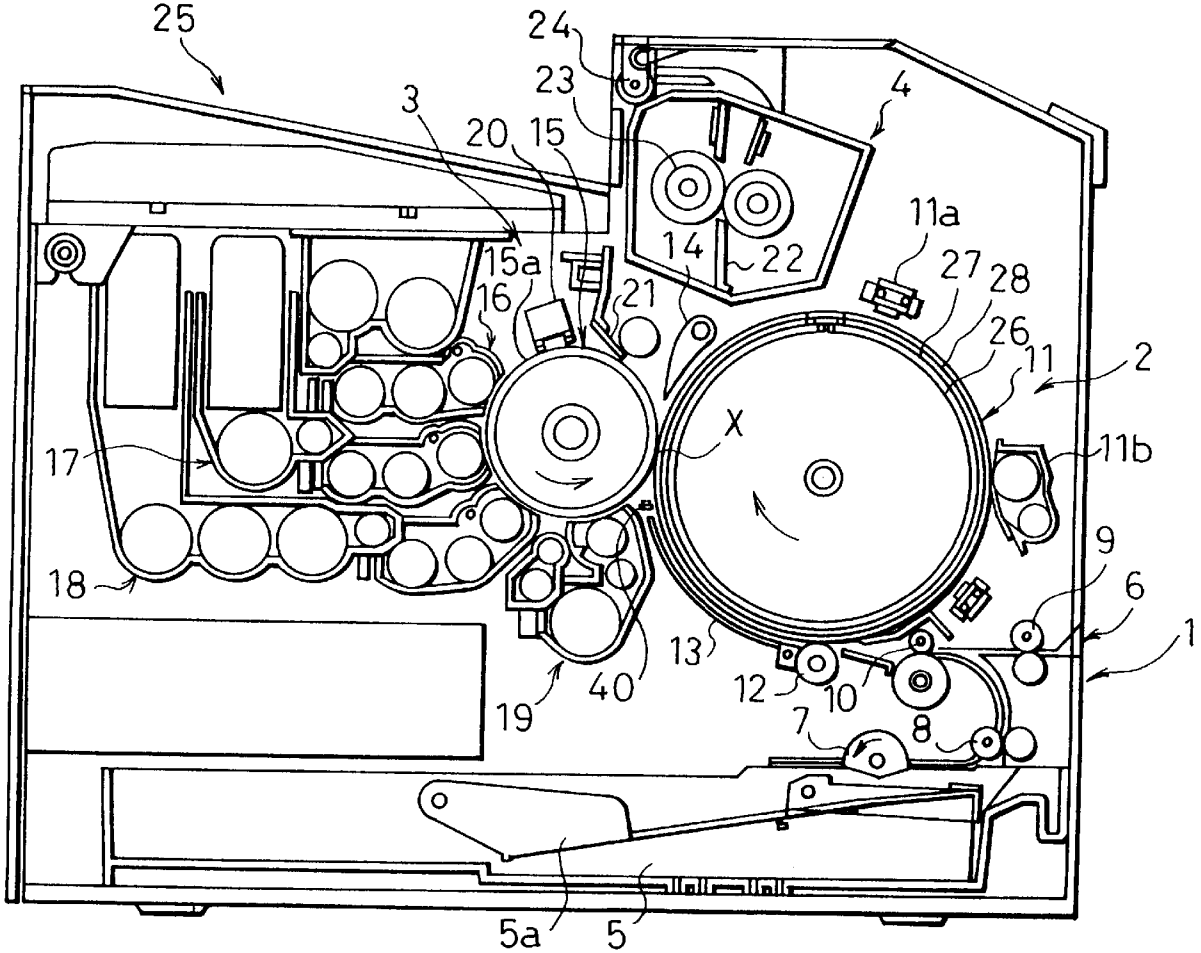
FIG. 2 is a cross-sectional view illustrating an arrangement of the whole of the image forming apparatus.

An image forming apparatus of the present embodiment, as shown in FIG. 2, is composed of a paper feeding unit 1 for storing and supplying transfer materials such as transfer sheets or OHP on which an image formed with toner is to be transferred, a transfer unit 2 for transferring the toner image onto the transfer material, a developing unit 3 for forming the toner image, and a fixing unit 4 for melting and fixing the toner image which has been transferred on the transfer material.

In the paper feeding unit 1, a paper feeding cassette 5 for storing the transfer materials and supplying them to the transfer unit 2 is removably installed at a bottom section of the image forming apparatus, whereas a paper hand-feeding unit 6 is also provided on a front side of a main body of the apparatus so that the transfer materials are manually fed one by one from the front side. The paper feeding unit 1 has a pick-up roller 7 for sending out the transfer materials one by one from the topmost one in the paper feeding cassette 5, a pre-feeding roller 8 for transporting the transfer material thus sent out by the pick-up roller 7, a hand-feeding roller 9 for transporting the transfer material supplied from the hand-feeding unit 6, and a pre-curling roller 10 for curling the transfer material thus transported thereto.

In the paper feeding cassette 5, a sending-out member 5*a* pushed up by a spring or the like is provided, and the transfer materials are piled on the sending-out member 5*a*. By doing so, the topmost one of the transfer materials in the paper feeding cassette 5 is brought into contact with the pick-up roller 7, and as the pick-up roller 7 rotates in an arrow direction, the transfer materials are sent out one by one toward the pre-feeding roller 8, then, to the pre-curling roller 10.

On the other hand, the transfer material supplied from the hand-feeding unit 6 is transferred by the hand-feeding roller 9 to the pre-curling roller 10.

The pre-curling roller 10 curls the transfer material as described above, and this is for causing the transfer material to more easily adhere to a surface of transfer drum 11 (transfer material carrier) in a cylindrical shape, which is provided in the transfer unit 2. The transfer drum 11 will be described in more detail later.

Around the transfer drum 11, there are provided a ground roller 12 which is grounded, a guiding member 13 for guiding the transfer material attracted to the transfer drum 11 so that it would not come off therefrom, and a separating claw 14 for forcibly stripping the transfer material adhering to the transfer drum 11. Note that the separating claw 14 is provided so that it can be set away from, and can be in contact with, the surface of the transfer drum 11.

Around the transfer drum 11, there is also provided a cleaning device 11*b* which operates after the transfer material is stripped from the transfer drum 11, for removing residual toner which adheres to the transfer drum 11. With this arrangement, the transfer drum 11 is cleaned prior to the adhesion of a next transfer material, making the adhesion of the next transfer material stable, and allowing a reverse surface of the next transfer material not to be soiled.

Furthermore, around the transfer drum 11, there is also provided a charge removing device 11*a*. The charge removing device 11*a* operates after residual toner is removed by the cleaning device 11*b*, for removing, from the transfer drum 11, residual electric charges which have been given thereto when the transfer material was separated therefrom. The charge removing device 11*a* is provided on an upstream side to the ground roller 12. By doing so, the transfer drum 11 has no residual charge, and a next transfer material is allowed to stably adheres thereto. Moreover, the potential after the separating step of the transfer material is adjusted to a normal level, and the transfer electric field is stabilized for the next transfer.

In the developing unit 3, a photosensitive drum 15 (image carrier) is provided in contact with the transfer drum 11. The photosensitive drum 15 is composed of a grounded conductive aluminum base cylinder 15*a* whose surface is covered with an OPC film (organic photo-semiconductor) 15*b*. Note that Se may be used instead of OPC.

Around the photosensitive drum 15, developers 16, 17, 18, and 19 are radially provided, which contain toners of yellow, magenta, cyan, and black, respectively. There are also provided a charger 20 for charging the surface of the photosensitive drum 15, and a cleaning blade 21 for scraping residual toner off the surface of the photosensitive drum 15. On the photosensitive drum 15, formation of a toner image is carried out with respect to each color toner. In other words, a set of charging, exposure, development, and transfer steps is repeated on the photosensitive drum 15 so that with respect to each toner color the step set is carried out.

Therefore, in the case of color transfer, through one rotation of the transfer drum 11, one toner image of one color is transferred onto a transfer material electrostatically adhering to the transfer drum 11. Therefore, through at most 4 rotations, one multicolor image can be obtained. Thus, applied to the present embodiment is a solid transfer body method wherein the transfer material is caused to adhere to the transfer drum 11 and an image is directly transferred thereto from the photosensitive drum 15.

Note that in the present embodiment, the photosensitive drum 15 and the transfer drum 11 are pressed against each other with a pressure of 8 kg/cm$^2$ at a transfer position, with transfer efficiency and picture quality taken into consideration.

Furthermore, in the image forming apparatus of the present invention, a light projecting device 40 is provided, for irradiating the photosensitive drum 15 before the transfer with respect to the transfer material and after the development, so that a background potential of an irradiated portion lowers.

In the fixing unit 4, there are provided a fixing roller 23 for fusing a toner image at a desired set temperature and with a desired set pressure, so that the toner image is fixed on the transfer material, and a fixing guide 22 for guiding, to the fixing roller 23, the transfer material thus stripped from the transfer drum 11 by the separating claw 14 after the transfer of the toner images. In addition, a discharge roller 24 is provided on a downstream side to the fixing unit 4 in the transfer material transport direction, so that the transfer material after fixation is discharged from the main body of the apparatus onto a discharge tray 25.

The following description will schematically explain an image forming process in the image forming apparatus arranged as above.

In the case of automatic feeding, transfer materials in the paper feeding cassette 5 are sent out one by one from the topmost one by the pick-up roller 7 to the pre-feeding roller 8. Then, the transfer material passing by the pre-feeding roller 8 is curled by the pre-curling roller 10 so that it conforms with a shape of the transfer drum 11.

On the other hand, in the case of manual feeding, the transfer materials are fed one by one from the hand-feeding unit 6 provided on the front of the main body of the apparatus, and is transported to the pre-curling roller 10 by the hand-feeding roller 9. The transfer material is curled by the pre-curling roller 10 so that it conforms with the shape of the transfer drum 11.

Thereafter, the transfer material thus curled by the pre-curling roller 10 is transported to between the transfer drum 11 and the ground roller 12. Then, charges are induced on a surface of the transfer material due to charges induced on the surface of the transfer drum 11. These charges cause the transfer material to electrostatically adhere to the surface of the transfer drum 11.

After that, the transfer material adhering to the transfer drum 11 is transported to a transfer position X where the transfer drum 11 and the photosensitive drum 15 come into contact, and due to a potential difference between charges of toner adhering to the photosensitive drum 15 and charges on the surface of the transfer material, the toner image is transferred onto the transfer material. Prior to the transfer with respect to the transfer material, the photosensitive drum 15 is irradiated by the light projecting device 40, depending on the types of the toners, so that charges are removed from portions of the photosensitive drum 15 corresponding to a background of the image (hereinafter referred to as background portions).

Here, a set of charging, exposure, development, and transfer processes is carried out for each color, by the photosensitive drum 15. Therefore, in the case of color transfer, one uni-color toner image is transferred onto the transfer material electrostatically adhering to the transfer drum 11 through one rotation of the transfer drum 11, and a multicolor image is obtained through utmost four rotations. Note that a monochrome image, or a uni-color image, is obtained through one rotation of the transfer drum 11.

When all the uni-color toner images are transferred onto the transfer material, the transfer material is forcibly separated form the surface of the transfer drum 11 by the separating claw 14 which is provided on the circumferential surface of the transfer drum 11 as to be set apart from and be in contact with the surface. The transfer material is guided to the fixing guide 22.

Thereafter, the transfer material is guided to the fixing roller 23 by the fixing guide 22, and the toner image on the transfer material is fused with heat and pressure of the fixing roller 22, and is fixed thereon. Then, the transfer material after the fixing operation is discharged onto the discharge tray 25 by the discharge roller 24.

The following description will explain a structure of the transfer drum 11 in detail.

Figure 3:
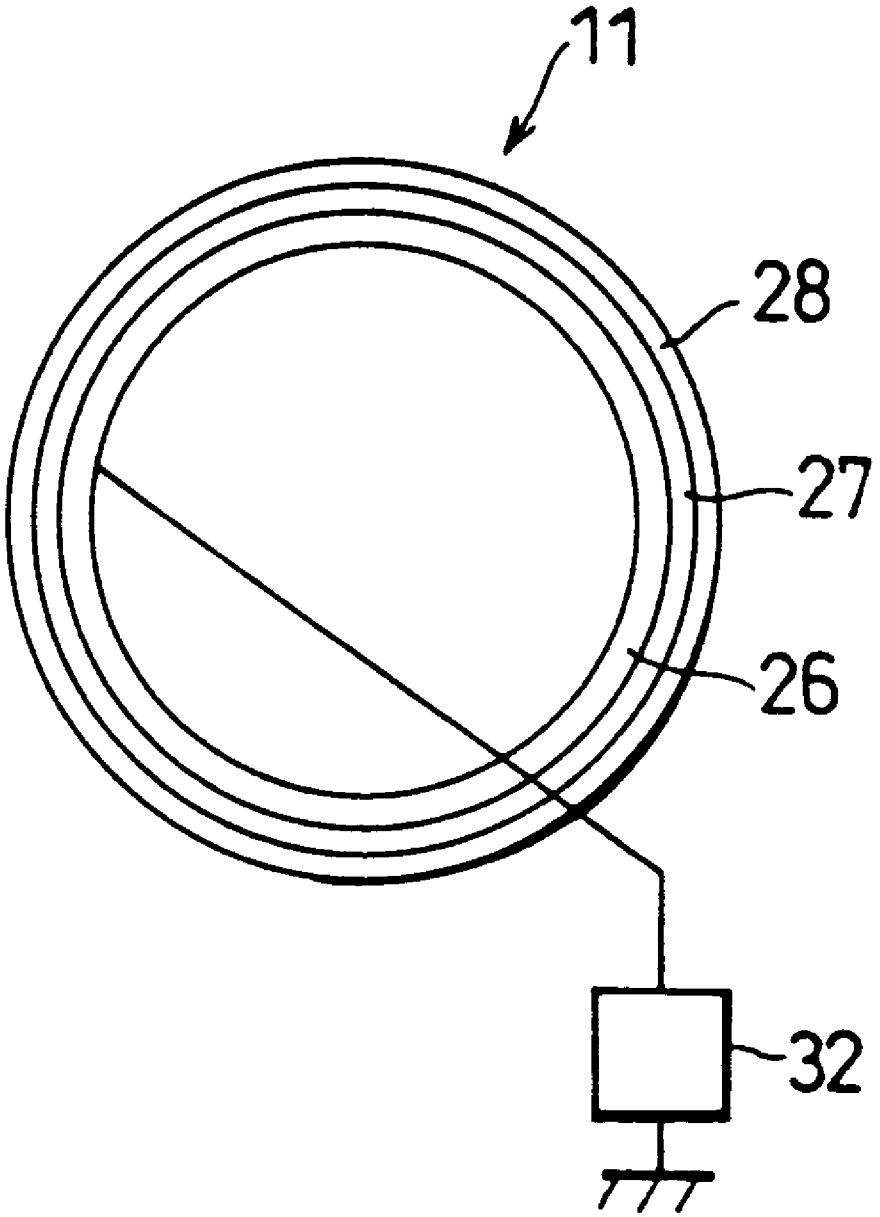
FIG. 3 is a cross-sectional view illustrating a schematic arrangement of a transfer drum of the image forming apparatus.

As illustrated in FIG. 3, the transfer drum 11 has (1) a conductive layer 26 made of aluminum, which constitutes a base in a cylindrical form, and (2) a semi-conductive layer 27 and (3) a dielectric layer 28 which are laminated on the conductive layer 26 in this order. A power source 32 for applying a voltage is connected to the conductive layer 26, so that a constant voltage is maintained throughout the conductive layer 26.

The semi-conductive layer 27 is made of an aerated urethane containing 5 to 30 parts by weight of conductive fine particles (0.1 to 10 $\mu$m) such as carbon. With this arrangement, the surface of the transfer drum 11 is made to be resilient. Besides, since being made of an aerated material, it has innumerable fine cavities on its surface, which form a gap between the semiconductor layer 27 and the dielectric layer 28. When a voltage is applied to the conductive layer 26 of the transfer drum 11 and a potential difference is generated between the transfer drum 11 and the ground roller 12, an atmospheric discharge occurs in the gap, and the atmospheric discharge generates a potential on a reverse surface (a surface on a side to the semiconductor layer 27) of the dielectric layer 28. As a result, a strong attracting force with respect to the transfer material is generated.

The dielectric layer 28 formed on the semiconductor layer 27 is made of polyvinylidene fluoride.

In the present embodiment, a cylinder made of aluminum is used as the conductive layer 26, but another conductive body may be used. The semi-conductive layer 27 is made of an aerated urethane, but any other semi-conductive resilient material such as silicon may be used. Moreover, the dielectric layer 28 is made of polyvinylidene fluoride, but another dielectric resin such as PET (polyethylene terephthalate) may be used.

Figure 4:
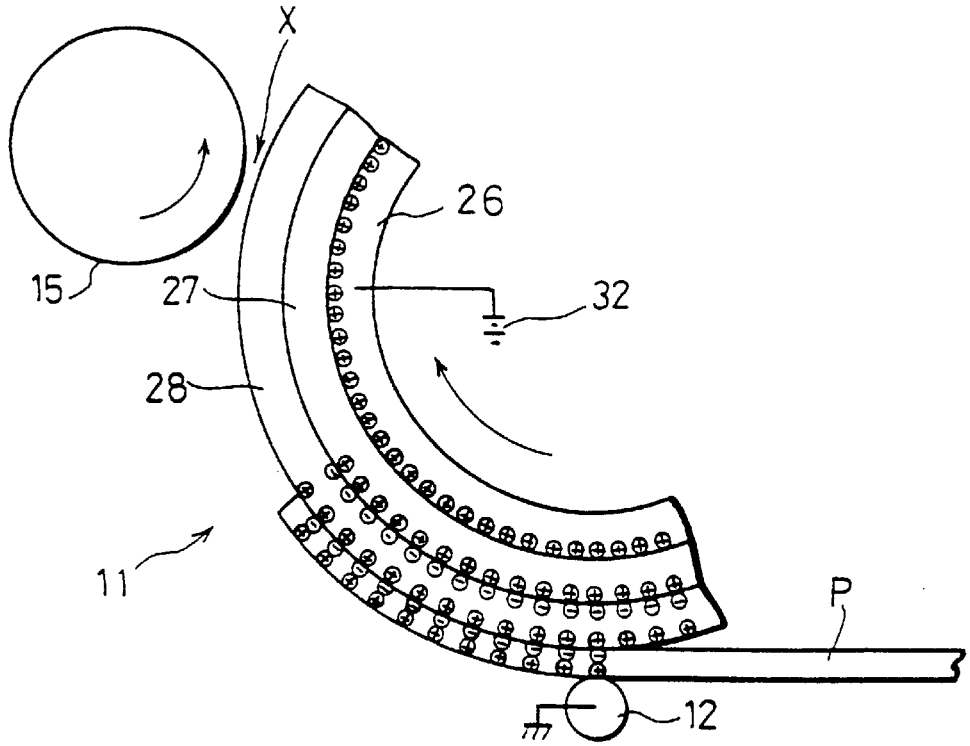
FIG. 4 is an explanatory view illustrating a charged state at an initial stage of a process wherein a transfer material is caused to adhere to the transfer drum so as to be transported.
Figure 5:
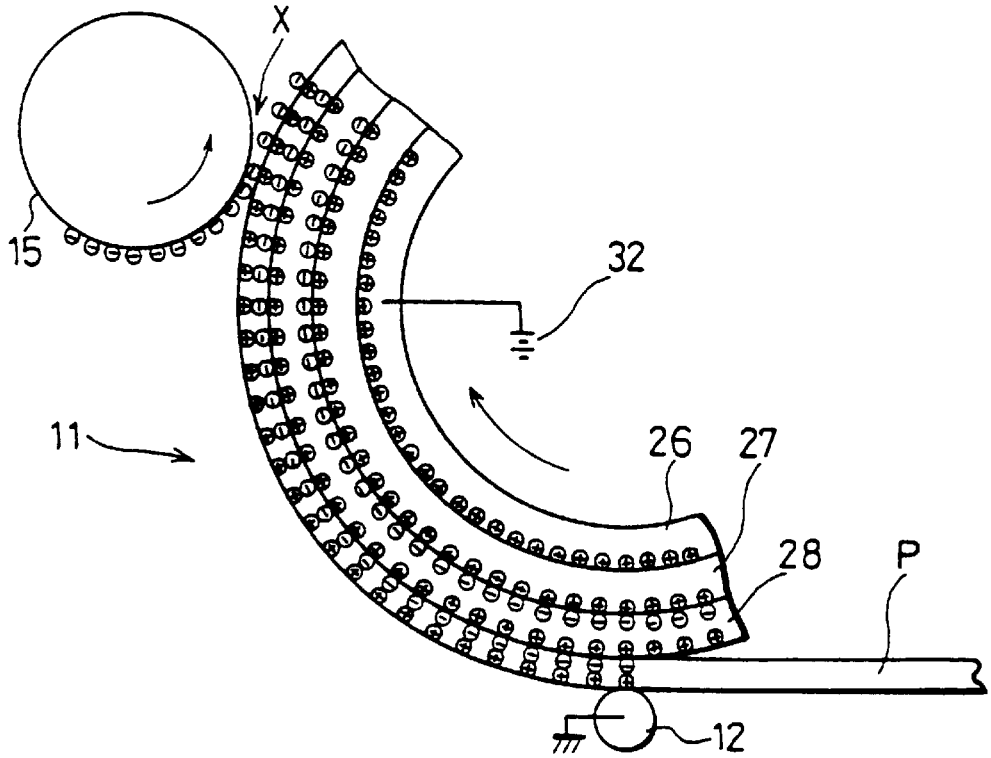
FIG. 5 is an explanatory view illustrating a charged state when the transfer material is transported to a transfer position of the photosensitive drum and the toner image is transferred onto the transfer material.
Figure 6:
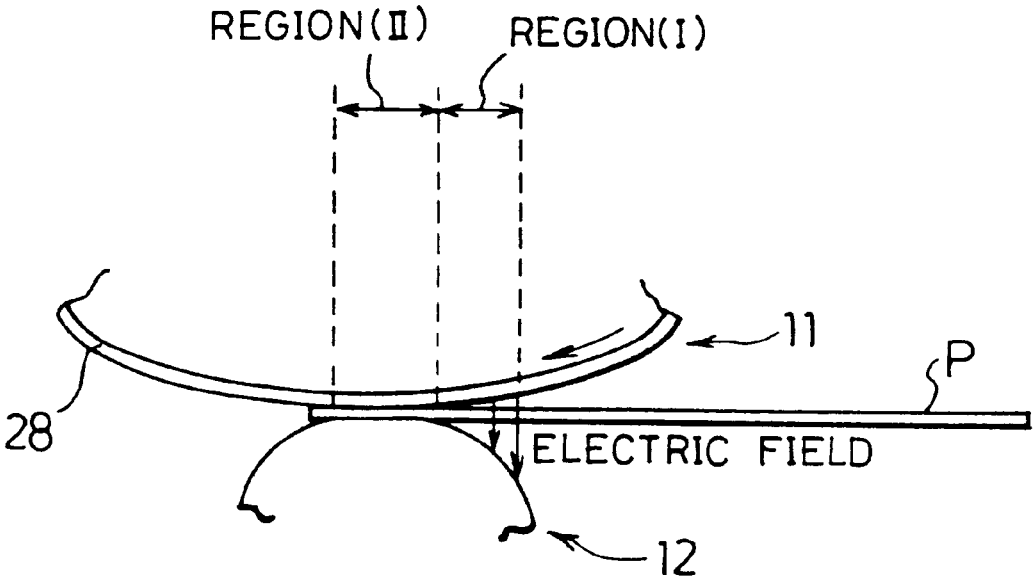
FIG. 6 is a view illustrating Paschen discharge at a nip between the photosensitive drum and a ground roller.

The following description will explain attracting and transfer operations of the transfer drum 11, while referring to FIGS. 4 through 6. Here, a voltage of a positive polarity is applied by the power source 32 to the conductive layer 26 of the transfer drum 11.

To begin with, the process for causing the transfer material P to adhere to the transfer drum 11 is explained below.

The dielectric layer 28 is charged with the use of the ground roller 12, mainly by Paschen discharge and injection of electric charges. To be more specific, as illustrated in FIG. 4, the transfer material P transported to the transfer drum 11 is pressed against the surface of the dielectric layer 28 by the ground roller 12, and electric charges accumulated in the semi-conductive layer 27 move to the dielectric layer 28. With this, positive charges are induced on the surface of the dielectric layer 28, and an electric field in a direction from the transfer drum 11 to the ground roller 12 is generated, as illustrated in FIG. 6. Note that the surface of the transfer drum 11 is homogeneously charged, due to the rotations of the ground roller 12 and the transfer roller 11.

As the ground roller 12 and the dielectric layer 28 of the transfer drum 11 become closer to each other, an electric field at a region where the dielectric layer 28 and the ground roller 12 come into contact, that is, a nip region, is intensified. Here, atmospheric dielectric breakdown occurs, and then, discharge from the transfer drum 11 side to the ground roller 12 side, that is, the Paschen discharge, occurs in a region (I).

After the discharge, in the nip region between the ground roller 12 and the transfer drum 11, that is, in a region (II), injection of electric charges from the ground roller 12 to the transfer drum 11 occurs, thereby causing accumulation of positive charges on the surface of the transfer drum 11. In other words, the Paschen discharge and the injection of charges accompanying the Paschen discharge cause negative charges to be accumulated on a reverse surface of the transfer material P, that is, the surface in contact with the dielectric layer 28. As a result, the transfer material P is caused to electrostatically adhere to the transfer drum 11.

Thus, charging is conducted not by atmospheric discharge but by contact. Therefore, only a low voltage is required so as to be applied to the conductive layer 26. Note that according to results of experiments, an appropriate voltage is not more than +3 kV, and more preferably at least +2 kV, so as to obtain good results of charging and transfer.

As the transfer drum 11 rotates in the arrow direction, the transfer material P adhering to the transfer drum 11 is transported to the transfer position X for transferring a toner image (see FIG. 4), with its outside surface positively charged.

The following description will explain a transfer process with respect to the transfer material P.

Toner particles having negative charges on their surfaces are caused to adhere to the photosensitive drum 15, as illustrated in FIG. 5. Therefore, in the case where the transfer material P whose surface is positively charged arrives at the transfer position X, a potential difference between the positive charges on the surface of the transfer material P and the negative charges of the toner causes the toner to adhere to the surface of the transfer material P. Thus, transfer of a toner image is carried out.

Since the adhesion and the transfer operation with respect to the transfer material P are carried out, not by injection of electric charges by atmospheric discharge which is usual in the conventional cases, but by induction of charges, an applied voltage may be low and control of the voltage is easy. Besides, unlike the case of the atmospheric discharge, the operations are not affected by ambient conditions such as humidity of the atmosphere, and the surface potential of the transfer drum 11 does not vary. Therefore, it is possible to eliminate defects in adhesion and printing. Furthermore, since the transfer drum 11 is charged by contact charging, the electric field region does not change even if the surface of the transfer drum 11 is scarred, and the electric field balance is not reversely affected by scars on the surface of the transfer drum 11. As a result, the transfer efficiency can be enhanced.

Figure 7:
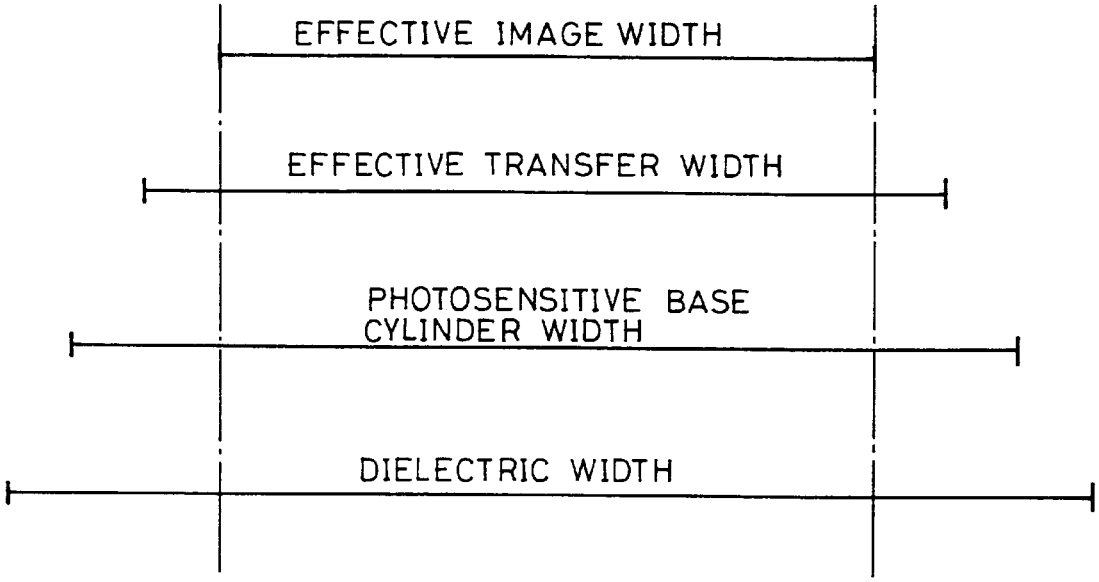
FIG. 7 is an explanatory view illustrating a relationship between a width of a portion to be charged and an effective image width of the photosensitive drum.

Here, as illustrated in FIG. 7, a width of the dielectric layer 28 of the transfer drum 11 is greater than a width of a photosensitive base cylinder (the aluminum base cylinder 15*a*) constituting the photosensitive drum 15, and the width of the photosensitive base cylinder is greater than an effective transfer width, and furthermore, the effective transfer width is greater than an effective image width (a width of an OPC film 15*b* which will be described later).

Figure 8:
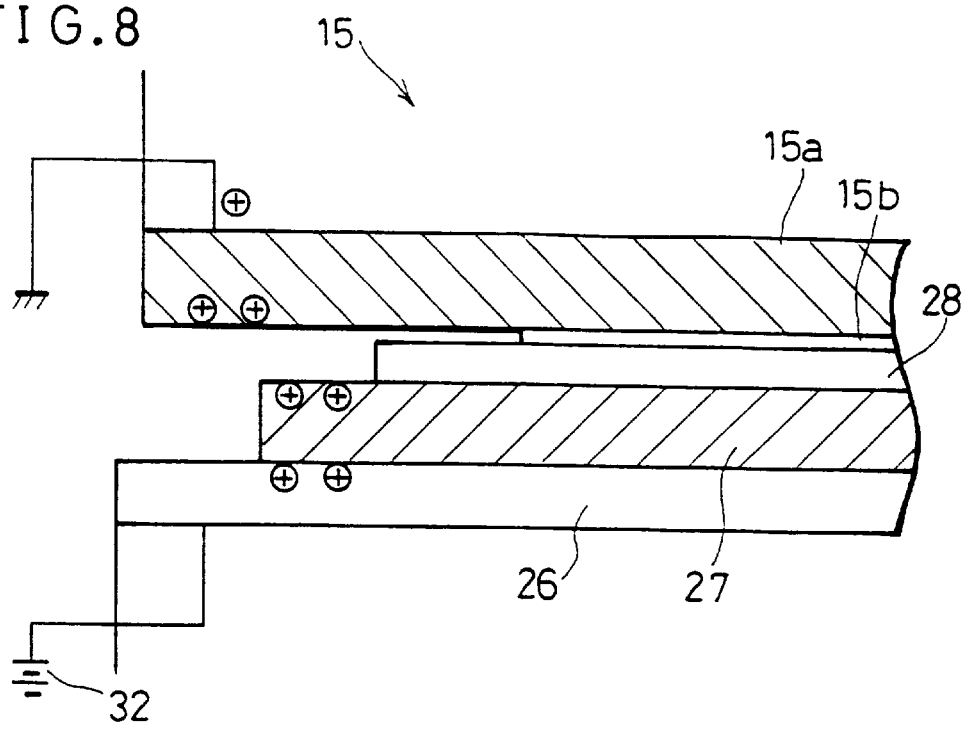
FIG. 8 is a view illustrating a movement of charges between the transfer drum and the photosensitive drum in the case where widths of layers of the transfer drum satisfy.

Here, the semi-conductive layer 27 may be in contact with the grounded aluminum base cylinder 15*a* of the photosensitive drum 15, in the case where, as illustrated in FIG. 8, the widths of the layers of the transfer drum 11 are set so as to satisfy the following relation:

WIDTH OF CONDUCTIVE LAYER 26>WIDTH OF SEMI-CONDUCTIVE LAYER 27>WIDTH OF DIELECTRIC LAYER 28

In this case, when a positive voltage is applied to the conductive layer 26 by the power source 32, positive charges are induced in the conductive layer 26, and the positive charges move to the surface of the semi-conductive layer 27. Here, if the aluminum base cylinder 15*a* and the semi-conductive layer 27 are in contact with each other, all the charges in the semi-conductive layer 27 move to the aluminum base cylinder 15*a*, and positive charges are not induced in the semi-conductive layer 28. Therefore, the transfer drum 11 fails to attract the negatively charged toner which adheres to the OPC film 15*b*, and transfer defects occur.

Therefore, as illustrated in FIG. 9, by setting the widths of the conductive layer 26 and the dielectric layer 28 equal, and setting the width of the semi-conductive layer 27 smaller than each of them, it is possible to prevent the semi-conductive layer 27 and the grounded aluminum base cylinder 15*a* from coming into contact, thereby enabling prevention of leakage of charges.

By doing so, the transfer drum 11 is caused to attract the negatively charged toner which adheres to the OPC film 15*b*, and transfer defects are eliminated.

Note that the transfer drum 11 has a diameter such that one transfer material winds around the transfer drum 11 without overlapping. In other words, the diameter of the transfer drum 11 is set in accordance with a maximum width or length of a transfer material for use in the image forming apparatus of the present embodiment. By doing so, the transfer material is stably attached to the transfer drum 11, and as a result, improvement of the transfer efficiency and the image quality is achieved.

It is generally known that the charge quantity of the transfer material P during the nip period varies with types of the transfer material P. In other words, an electric field for attracting and holding the transfer material P varies with types of the transfer material P. Note that the nip period means a period of time which it takes for a certain position of the transfer material P to pass through the nip region formed between the ground roller 12 and the transfer roller 11.

Here, a method for adjusting the nip period is explained. As illustrated in FIG. 10, the present image forming apparatus has a transfer material detecting sensor 33 for detecting a type of the transfer material P. The transfer material detecting sensor 33 is connected to a CPU 51 which will be described later. Being controlled by the CPU 51, the transfer material detecting sensor 33 measures physical properties of the transfer material P prior to the electrostatic adhesion of the transfer material P to the transfer drum 11, so that the type of the transfer material P is detected.

To be more specific, the transfer material detecting sensor 33 judges whether the transfer material P is a sheet of paper or a synthetic resin sheet for OHP by measuring, for example, a transmittance, while it judges whether the transfer material P is thick or thin by detecting a thickness. Then, the nip period is adjusted depending on the type of the transfer material P which is thus detected (for example, depending on whether it is a sheet of paper or a synthetic resin sheet for OHP, or whether it is thick or thin).

The nip period is found by calculating:

$$\frac{\text{WIDTH OF NIP REGION BETWEEN TRANSFER DRUM 11 AND GROUND ROLLER 12}}{\text{ROTATION VELOCITY OF TRANSFER DRUM 11}}$$

The width of the nip region (nip width) can be adjusted by varying the hardness of the semi-conductive layer 27.

Note that the ASKER C standard is used for the hardness of the semi-conductive layer 27. The ASKER C standard is a standard established by the Rubber Association of Japan. To be more specific, an ASKER C durometer measures a depth which a hardness-measurement-use needle with a spherical tip reaches when the needle is pressed against a sample by using a spring and a resistivity of the sample and a strength in the spring become equilibrate, and expresses the degree of the depth as a degree of hardness. According to the ASKER C standard, in the case where a depth of the needle when the spring is subjected to a load of 55 g is equal to a maximum displacement of the needle, a degree of hardness of a sample used is given as 0. In the case where a depth of the needle when the needle is subjected to a load of 855 g is 0, a degree of hardness of a sample used is given as 100. Table 1 below shows relationship between hardnesses based on the ASKER C standard and attracting effects.

TABLE 1

| HARDNESS | 10 | 15 | 20 | 25 | 30 | 40 | 50 | 60 | 70 | 80 | 90 |
|---|---|---|---|---|---|---|---|---|---|---|---|
| ATTRACTING EFFECT | x | x | Δ | ○ | ○ | ○ | ○ | Δ | Δ | Δ | x |

Hardness is in accordance with the ASKER C standard of the Rubber Association of Japan.

In Table 1, "o" signifies that the attracting effect was strong, indicating that the transfer material P was caused to electrostatically adhere to the transfer drum 11 in a stable state while the transfer drum 11 made four rotations (transfers four color toner images). "Δ" signifies that the attracting effect was weak, indicating that the transfer material P electrostatically adhered to the transfer drum 11 while the transfer drum made four rotations, but either a top edge or a bottom edge of the transfer material P came off. "x" signifies that there was no attracting effect, indicating that the transfer material P came off from the transfer drum 11 before the transfer drum 11 completed four rotations.

From Table 1, it is clear that a substantial attracting effect with respect to the transfer material P is achieved by setting the hardness of the semi-conductive layer 27 in a range of 20 to 80 of ASKER C. In other words, the hardness of the semi-conductive layer 27 is preferably set in a range of 20 to 80 of ASKER C, since in this case the transfer material P is caused to electrostatically adhere to the transfer drum 11 through four rotations of the transfer drum 11. Besides, the hardness of the semi-conductive layer 27 is more preferably set in a range of 25 to 50 of ASKER C, since in this case the transfer material P is caused to electrostatically adhere to the transfer drum 11 in a more stable state, throughout four rotations of the transfer drum 11.

It should be noted that in the case where the hardness of the semi-conductive layer 27 is lower than 20 of ASKER C, such a low hardness causes the transfer material P to reversely curl (curl not along the transfer drum 11). As a result, the transfer material P does not electrostatically adhere to the transfer drum 11 in a stable condition. Thus, setting the hardness of the semi-conductive layer 27 lower than 20 of ASKER C is not preferable.

On the other hand, in the case where the hardness of the semi-conductive layer 27 is higher than 80 of ASKER C, such a high hardness causes the nip width between the transfer drm 11 and the ground roller 12 to becomes too narrow. As a result, the transfer material P is hot caused to electrostatically adhere to the transfer drum 11 in a stable condition. Thus, such a high hardness is not preferable. Besides, in the case where the hardness of the semi-conductive layer 27 is higher than 80 of ASKER C, such a high hardness causes the photosensitive drum 15 and the transfer drum 11 to be subjected to an excessive contact pressure. As a result, the durability of the photosensitive drum 15 is impaired.

The nip width can be adjusted by varying the contact pressure between the transfer drum 11 and the ground roller 12. The contact pressure between the transfer drum 11 and, the ground roller 12 can be varied and adjusted by, for example, providing under the ground roller 12 an eccentric cam for depressing the ground roller 12 so that a depressing force of the eccentric cam against the ground roller 12 is varied and adjusted by rotating the eccentric cam.

Here, the relation between the nip width and the attracting effect of the transfer material P is shown in Table 2. Note that o, Δ, and x respectively indicate the same as in Table 1.

TABLE 2

| NIP WIDTH (mm) | 0.0 | 0.5 | 1.0 | 2.0 | 3.0 | 4.0 | 5.0 | 6.0 | 7.0 |
|---|---|---|---|---|---|---|---|---|---|
| ATTRACTING EFFECT | x | Δ | ○ | ○ | ○ | ○ | Δ | x | x |

It is clear from Table 2 that by setting the nip width in a range of 0.5 mm to 5.0 mm, it is possible to cause the transfer material P to electrostatically adhere to the transfer drum 11 all through four rotations of the transfer drum 11. In other words, a nip width of 0.5 mm to 5.0 mm is preferable from a viewpoint of dynamic strength (mechanical strength), and a nip width of 1.0 mm to 4.0 mm is optimal from the viewpoint of dynamic strength (mechanical strength).

Note that a nip width narrower than 0.5 mm is not preferable since in such a case the ground roller 12 does not rotate following the transfer drum 11 and accordingly does not stably hold and transport the transfer material P during the four rotations of the transfer drum 11. On the other hand, in the case of a nip width wider than 5.0 mm, a nip pressure becomes so great that the transfer material P is reversely curled (curled not along the transfer drum 11). As a result, the transfer material P is not caused to electrostatically adhere to the transfer drum 11 in a stable condition. Therefore such a wide nip width is not preferable.

As described above, in the case where the transfer drum 11 rotates at a constant speed, the nip period can be easily controlled by adjusting the hardness of the semi-conductive layer 27 and/or the contact pressure between the transfer drum 11 and the ground roller 12. On the other hand, by fixing the nip width whereas making the rotation velocity of the transfer drum 11 variable, the nip period can be adjusted as well. However, it should be noted that in the case where the nip period is controlled by adjusting the rotation velocity of the transfer drum 11, it is necessary to slow the rotation of the transfer drum 11 so as to increase the nip period. In the case where the rotation of the transfer drum 11 is thus slowed, the transfer efficiency per minute deteriorates. From this reason, it is more preferable to adjust the nip period by controlling the hardness of the semi-conductive layer 27 and/or the contact pressure between the transfer drum 11 and the ground roller 12.

The following description will explain the light projecting device 40 in detail.

The light projecting device 40 is intended to project light on the photosensitive drum 15 before the transfer with respect to the transfer material and after the development, as illustrated in FIG. 2.

Incidentally, there are the reversal development and the regular development, as a developing method applicable to the image forming apparatus of electrostatic electrophotography. The regular development is a developing method wherein the photosensitive drum 15 is charged with a high DC voltage, the charges are decreased by exposing the photosensitive drum 15 so as to form a latent image, and with respect to the latent image, toner particles having electric charges with a polarity opposite to that of the photosensitive drum 15 are caused to adhere to background portions so that a toner image is formed.

On the other hand, the reversal development is a method wherein with respect to the latent image formed as above, toner particles having electric charges with the same polarity as that of the photosensitive drum 15 is caused to adhere to exposed portions so that a toner image is formed. In the case of the reversal development, potentials of the background portions in the photosensitive drum 15 remain high even after the development, and a transfer currency becomes great on the transfer of toner to a transfer material. Therefore, the transfer drum 15 has a great attracting force with respect to the transfer material P. As a result, in the separating process after the transfer, the toner image which has been transferred onto the transfer material P becomes unstable, or the toner comes off and discharges electricity, thereby scattering on the transfer material P.

Therefore, as illustrated in FIG. 11, the image forming apparatus of the present embodiment is arranged so that residual charges in the background portions of the photosensitive drum 15 are removed by exposing the whole surface of the photosensitive drum 15 before the transfer and after the development by using the light projecting device 40. Thus, by lowering the potentials of the background portions where toner is adhering, the separation property of the transfer material P from the transfer drum 11 after the transfer is enhanced.

The light projecting device 40 has an LED (light emitting diode) array 41 for exposing the photosensitive drum 15. Specifically, regarding the exposure of the photosensitive drum 15, it is necessary to project light which is adjusted to a sensitivity property of a carrier generating layer of the photosensitive drum 15 and has a wavelength outside a band of absorbed wavelengths of a carrier transferring layer of the photosensitive drum 15, in order to prevent fatigue of the photosensitive drum 15 and ensure carrier transfer which is stable even as aging.

Therefore, in the present embodiment, an LED array which has sensitivity with respect to a red wavelength band is used as the LED array 41. To be more specific, the LED array 41 has a wavelength band ranging 600 to 780 nm, and LED elements in the LED array 41 are provided at a pitch of 5 mm. The LED array 41 is positioned at a distance of about 15 mm from the photosensitive drum 15. Besides, as will be described later, an excellent charge-removing effect was obtained when an input voltage of 2.2 V to 5.0 V was applied to the LED array 41.

Note that here the case where the LED array 41 is used is described as an example of the present embodiment, but the invention is not limited to this case. It has been known that the same effect can be achieved by using a fluorescent lamp having a wavelength band of not lower than 500 nm and cutting off short wavelength components by using an optical filter.

Here, as illustrated in FIG. 11, the LED array 41 is installed above the developer 19 which contains black toner and is positioned at the lowest position among the developers. In addition, a shielding blade 42 is provided on a side of the LED array 41 to a developer sleeve 19*a*.

In the image forming apparatus, normally, a section where the photosensitive drum 15, the transfer drum 11, and the developer 19 has a small spare space. As a result, light of the LED array 41 may possibly intrude the closest developing section and distort an image during the developing process. Therefore, by providing the shielding blade 42, a desirable effect of removing background potentials can be achieved without distorting an image, even in the case where a non-directional LED array is used as the LED array 41.

Furthermore, the same effect can be achieved when an optical path of the LED array 41 is restricted, that is, a directional LED array is used as the LED array 41, instead of providing the shielding blade 42. For example, in the case where a usual directional LED array having an LED cover caving in a lens form is used as the LED array 41, light leakage to surrounding portions does not occur. To be more specific, in the case where the LED array 41 had a cover over light-emitting parts which had a surface of 3 mm square and it was positioned at a distance of about 10 mm from the surface of the photosensitive drum 15, it was found that the projected light was converged onto an about 5 to 7 mm wide region. Such conversion of the light made it possible to suppress intrusion of light into a surrounding developed portion.

Note that intrusion of light in the present embodiment was checked in a state where the LED array 41 was positioned so as to have a distance of 13 to 17 mm from the developed portion of the photosensitive drum 15, and it was found that the developed portion was not affected at all.

In addition, in the case where a fluorescent lamp is used as the light projecting device 40 and a difficulty exists in setting a light quantity of the fluorescent lamp when restricting the optical path thereof is attempted, a desired result may be obtained by setting the light quantity to a level such that the background potential sufficiently decreases by exposure.

In the aforementioned case, the shielding blade 42 is provided so as to be applied to the non-directional LED array 41. However, the present invention is not limited to this arrangement in the case where the non-directional LED array is used therein, and as illustrated in FIG. 12, a light-emitting surface of the LED array may be positioned on a side to the photosensitive drum 15 with respect to a tangent line of the photosensitive drum 15 which orthogonally crosses a line connecting a center of the photosensitive drum 15 and a center of the developer sleeve 19*a*. By doing so, intrusion of light from the light-emitting surface into a portion under the developing process may be prevented. As a result, a desirable performance can be obtained only by controlling the light quantity emitted by the LED array 41 to a level required for removing the background potential, while loss of the effect due to an inclination of the light-emitting surface of the LED array 41 is reduced. It should be noted that by this method, the same effect may be achieved with the use of the fluorescent lamp to which the optical filter is applied.

On the other hand, the turning on/off of the light projecting device 40 is controlled by a control unit 50, as illustrated in FIG. 13.

The control unit 50 has a CPU (central processing unit) 51, a developing unit operation data memory 52, a toner data memory 53, a timer 54, a D/A converter 55, and an LED driving power source 56.

The developing unit operation data memory 52 stores an operation control program and a toner type judging program for causing the developing unit 3, the transfer unit 2, and the like to operate based on data such as printing modes of colors including black, which are supplied from an operation panel (not shown).

The toner data memory 53 is composed of a RAM (random access memory), and stores toner data on various types of toner. The toner data include data on toners of various colors, a toner for monochrome development, toners whose colorants are made of conductive materials, toners whose colorants are made of non-conductive materials, and so on.

The timer 54 checks a time lapse during the transfer process, and it may be a built-in type or an attached type.

The LED driving power source 56 is intended for turning on/off the LED array 41 which is disposed before the transfer region and behind the development region, in response to signals supplied from the CPU 51 through the D/A converter 55.

Figure 1:
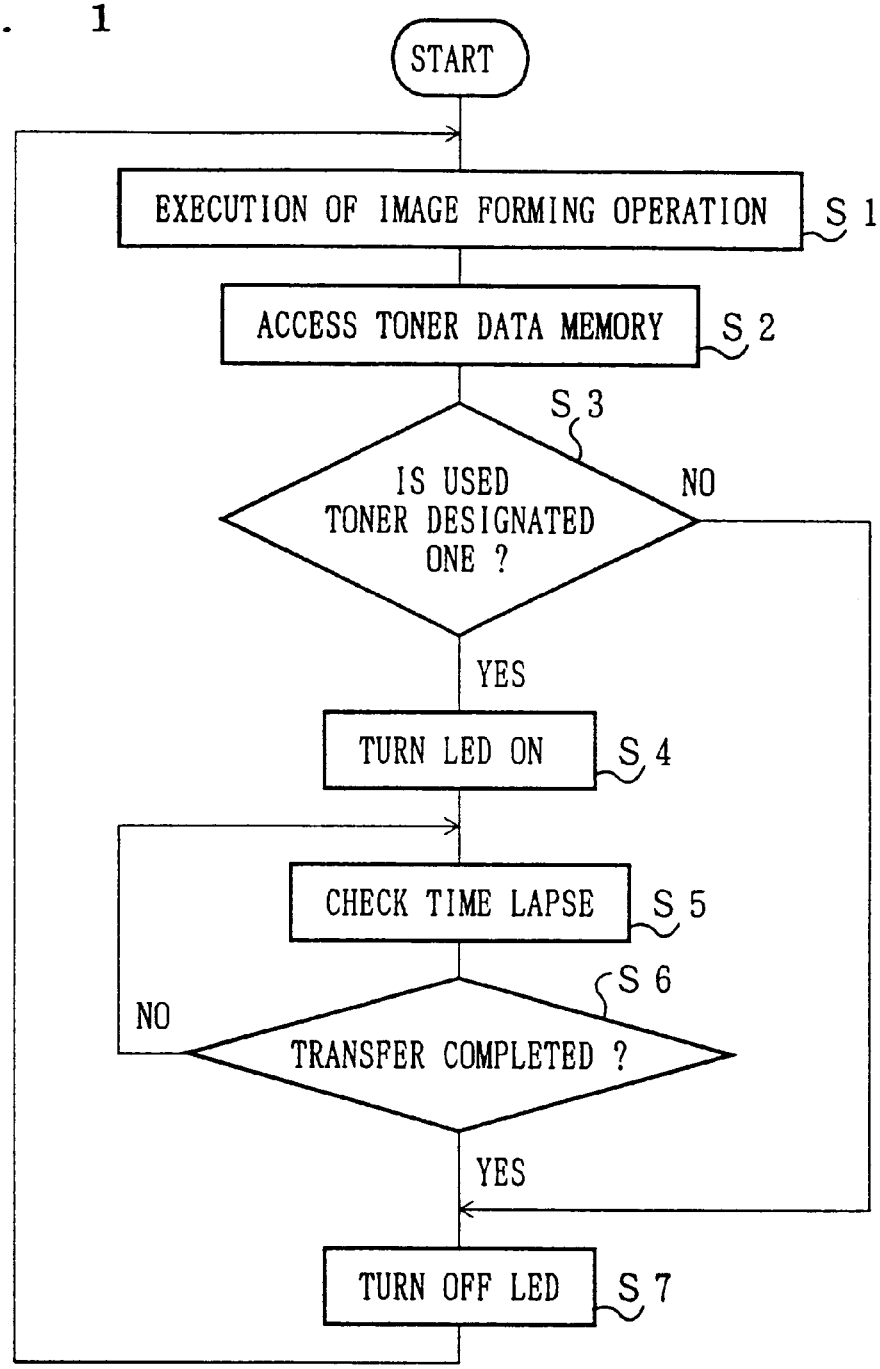
FIG. 1 is a flowchart showing an operation sequence of an image forming apparatus in accordance with an embodiment of the present invention.

The following description will explain a control operation by the control unit 50 arranged as above, while referring to a flowchart in FIG. 1.

To start with, in the control unit 50, the operation control program and the toner type judging program are loaded in the CPU 51 on the turning-on of the image forming apparatus. An input signal selected on printing is received through the developing unit operation data memory 52, printing is started with toners of various types, based on a printing mode such as selected colors. When an image forming operation is carried out with the use of toners of various types (S1), the toner data memory 53 is accessed (S2), and it is judged whether the toners are designated toners or not (S3).

Subsequently, in the case where a toner to be used now is a designated toner, the LED array 41 disposed before the transfer region and behind the development region is turned on, with power supplied through the D/A converter 55, and the background potential of the photosensitive drum 15 is lowered by removing electric charges by exposure (S4).

The designated toners which are mentioned above are toners whose data have previously been stored in the toner data memory 53, including: (1) color toners; as well as, among toners for monochromatic printing, (2) black toners whose colorants are made of non-conductive materials; (3) black toners in which carbon accounts for a small part; and (4) black toners which is processed so as to be non-conductive even though carbon accounts for a large part in it, and the like.

Then, the timer 54 checks a time lapse (S5), and when it is checked that a predetermined period has passed (S6), the LED array 41 is turned off (S7).

Subsequently, the flow returns to the step S1, and an operation with respect to the next transfer material P starts.

Note that in the case where it is found in the step S2 that the toner to be used for image formation is not a designated toner, the flow goes to the step S6 so that the LED array 41 remains in the off state.

Thus, the above flowchart is on the monochromatic printing, intended for controlling the turning on/off of the LED array 41 in accordance with a checking result on whether or not the toner to be used is one of the designated toners.

In the case of color printing, as illustrated in FIG. 14, the LED array 41 is likewise turned on/off in accordance with a result of judgment in a step S13 on whether or not a toner to be used is a color toner, which corresponds to the step S3 in the case of the monochrome printing. To be more specific, since the color toners including yellow, magenta, and cyan toners are generally non-conductive, it is possible to judge whether or not a toner to be used is a color toner. Therefore, the LED array 41 is arranged so as to be turned on based on this judgment.

Moreover, by doing so, the LED array 41 is sequentially turned on in the case of printing by laminating color toner images (hereinafter referred to as laminating print), and hence it is possible to prevent the transfer electric field from lowering as a transfer operation is repeated in the laminating transfer.

Thus, the image forming apparatus in accordance with the present embodiment is arranged so that in an image forming operation, an electrostatic latent image is formed on the photosensitive drum 15 which is charged, and toner is caused to adhere to the electrostatic latent image so as to form a toner image.

On the other hand, the transfer material P on which the toner image is to be transferred is caused to electrostatically adhere to the transfer drum 11 and is transported to the transfer position X between the photosensitive drum 15 and the transfer drum 11. At the transfer position X, the toner image is transferred onto the transfer material P.

In the case where a multi-color image is to be formed, the toner image of the first color is transferred onto the transfer material P at the transfer position X, and thereafter, the transfer material P remains adhering to the transfer drum 11 and is again transferred to the transfer position X for the transfer of a toner image of the next color. Thus, the toner images of each color are laminated on the transfer material P.

Thus, one transfer operation is finished in the case where a black image or a uni-color image is formed, or transfer operations with respect to all of color toner images is finished in the case where a multi-color image is formed, and thereafter the transfer material P is stripped away from the transfer drum 11. In short, the present embodiment is intended to be applied with respect to a so-called solid transfer body.

Incidentally, in the case of the reversal development in particular, a high transfer voltage is required since the background potential of the photosensitive drum 15 is high even after the development. Therefore, an attracting force of the transfer drum 11 with respect to the transfer material P increases. As a result, in the separating step of the transfer material P from the transfer drum 11, the toner image which has been transferred onto the transfer material P becomes unstable, or the toner comes off and discharges electricity.

To avoid this problem, residual charges in the background portions of the photosensitive drum 15 are removed by exposing the whole surface of the photosensitive drum 15 before the transfer and after the development. By doing so, the transfer voltage is decreased, thereby resulting in enhancement of separation property. However, unconditional lowering of the background potential before transfer may cause the potential of the toner image to rise, thereby causing scatter of the toner on the photosensitive drum 15 before transfer.

On the other hand, in the case where the laminating transfer is carried out by using toners of various colors, the photosensitive drum 15 and the transfer material P contact each other in every transfer operation, and as the contact is thus repeated, the surface potential of the transfer material P rises due to the background potential of the photosensitive drum 15.

Therefore, as the transfer operation is repeated twice, three times, or the like in the laminating transfer, the effective transfer electric field gradually becomes smaller.

Therefore, such a rise of the surface potential of the transfer material P due to the background potential should be preferably suppressed.

For this purpose, in the present embodiment, the light projecting device 40, which projects light on a portion of the photosensitive drum 15 on an upstream side to the toner image transfer position X and on a downstream side to the portion subjected to the development process, is arranged so as to take an ON state or an OFF state, in accordance with the toner type.

A phenomenon that a potential of the toner image rises as the background potential of the photosensitive drum 15 is lowered tends to occur in the case where the toner has great conductivity. For example, in the case of a black toner containing much carbon, a potential of the toner image increases, with the conductive carbon influenced by light projected thereto.

Therefore, the aforementioned phenomenon hardly occurs in the case of a color toner, which does not have great conductivity, or a black toner in which carbon accounts for a small part, or which is processed so as to be non-conductive even though carbon accounts for a large part in it.

For this reason, the background potential can be lowered with the surface potential of the toner image maintained, by carrying out light projection by the light projecting device 40 only in the case of a color toner, which does not have great conductivity, or a black toner in which carbon accounts for a small part or which is processed so as to be non-conductive even though carbon accounts for a large part in it.

As a result, by appropriately control the background potential of the photosensitive drum 15 in the image forming apparatus having the transfer drum 11, it is possible to prevent blur of edges of thin lines and characters, and scatter of toner, which tend to occur on the light projecting operation, and also it is possible to prevent the lowering of the effective transfer electric field. By doing so, the separation property is improved, and the image forming apparatus is made capable of producing images with high quality.

Besides, in the image forming apparatus of the present embodiment, light projection on the photosensitive drum 15 by the light projecting device 40 is controlled so as to be carried out only in the case where the used toner is a color toner. Thus, by turning on the light projecting device 40 only in the case where a color toner is used, it is enabled to lower the background potential with the toner image surface potential maintained, in the case of multi-color image formation. By doing so, prevention of scatter of toner, stabilization of transfer, and improvement of the separation property are achieved, and an excellent image quality is obtained. Note that it is possible to distinguish color toners, since the color toners usually do not contain carbon, and hence, they are non-conductive.

In the image forming apparatus of the present embodiment, light projection on the photosensitive drum 15 by the light projecting device 40 is controlled so as to be carried out only in the case where a colorant of the toner used is not a conductive material.

Therefore, in the case where a black toner whose colorant is not a conductive material is used, it is ensured that only the background potential is lowered with the toner image surface potential maintained. As a result, even though the black toner is used, prevention of scatter of toner, stabilization of transfer, and improvement of the separation property are achieved, and an excellent image quality is obtained.

[Second Embodiment]

The following description will explain another embodiment of the present invention, while referring to FIGS. 15 through 17. The members having the same structure (function) as those in the above-mentioned embodiment will be designated by the same reference numerals and their description will be omitted.

An image forming apparatus of the present embodiment is arranged so that a light quantity of an LED array is controlled, in accordance with a potential of the photosensitive drum 15.

To be more specific, in the image forming apparatus of the present embodiment, a light projecting device 60 as light projecting means has an LED array 61 which is arranged so that a quantity of light projected on the photosensitive drum 15 is adjusted by a light quantity adjusting unit 62.

Besides, there are provided (1) a toner image surface potential sensor 63 (toner image surface potential measuring means) for measuring a surface potential of the photosensitive drum 15 on which a toner image is formed, at a position directly on an upstream side of the LED array 61 in a rotation direction of the photosensitive drum 15, that is, at a position behind the development region and before the light projection region for lowering the background potential, and (2) a charged surface potential sensor 64, on a downstream side of the charger 20, for measuring a surface potential of the photosensitive drum 15 when charged, that is, a background potential.

A control unit 70 for controlling the light projecting device 60 has, as illustrated in FIG. 16, a CPU 71, a developing unit operation data memory 72, a toner data memory 73, a timer 74, a D/A converter 75, and an LED driving power source 76, which have the same functions as those in FIG. 13, respectively. The toner image surface potential sensor 63, the charged surface potential sensor 64, an amplifier 77, an A/D converter 78, and a potential difference calculation-use data memory 79 (memory means) are also provided in the control unit 70.

In the control unit 70, the surface potential of the charged photosensitive drum 15 is detected by the charged surface potential detecting sensor 64. A detection signal obtained is sent to the CPU 71 through the amplifier 77 and the A/D converter 78, and then, it is stored in the potential difference calculation-use data memory 79.

Subsequently, on the photosensitive drum 15 on which the toner image is formed, a toner image surface potential is detected by the toner image surface potential sensor 63. Like in the above case, a detection signal obtained is sent to the CPU 71 through the amplifier 77 and the A/D converter 78, and then, it is stored in the potential difference calculation-use data memory 79.

Thereafter, the CPU 71 as projected light quantity controlling means compares the charged surface potential Vs detected by the charged surface potential sensor 64 and the toner image surface potential Vt detected by the toner image surface potential sensor 63. Then, based on data on a relation between the surface potential of the photosensitive drum 15 and an input voltage for LED as shown in FIG. 17, a signal such that a potential difference (Vs−Vt) becomes substantially 0 is sent to the LED driving power source 76 through the D/A converter 75, so that a light quantity of the LED array 61 of the light projecting device 60 is adjusted by the light quantity adjusting unit 62.

Specifically, according to the surface potential-LED input voltage relation data of FIG. 17, when a charged surface potential Vs is −700 V to −900 V, the surface potential becomes about −280 V in the case where an input voltage of 2.0 V is applied to the LED array 61, while it becomes about −100 V in the case where an input voltage of 5.0 V is applied thereto.

As shown in examples which will be described later, the charged surface potential Vs of the photosensitive drum 15 becomes substantially equal to the toner image surface potential Vt in the case where light projection is performed with an input voltage to the LED array 61 set to about 2 V. In this case, even when a toner in which carbon of 10 percent by weight was dispersed was used, no scatter of toner was observed.

In the case where the input voltage to the LED array 61 is set to 5.0 V, the surface potential becomes about −100 V. By doing so, laminating transfer can be perfected without lowering the effective transfer potential for the subsequent transfer operations of the second and later colors.

Thus, the toner image surface potential Vt of the photosensitive drum 15 varies at every color and every development. Besides, the charged surface potential Vs of the photosensitive drum 15 also varies as aging or in response to changes in a quantity of charges of the toner.

Furthermore, in the case where laminating transfer with the use of toners of various colors is conducted, the effective transfer electric field gradually becomes smaller.

On the other hand, a rise of the surface potential of the transfer material P caused by the background potential of the photosensitive drum 15 varies with the types of the transfer material P, and in the case where OHP is used as the transfer material P, a toner image of the last color may not be transferred after repeated transfer operations.

Therefore, it is preferable that the background potential after development and before transfer is lowered in accordance with the type of the transfer material P and various development conditions, so that the rise of the surface potential of the transfer material P due to the background potential is suppressed.

In contrast, in the present embodiment, the CPU 71 is provided so as to control the quantity of light to be projected on the photosensitive drum 15 by the light projecting device 60 based on a difference between (1) the toner image surface potential Vt detected by the toner image surface potential sensor 63 and (2) the charged surface potential Vs of the photosensitive drum 15 which is previously measured and stored in the potential difference calculation-use data memory 79.

Therefore, the toner image surface potential Vt on the photosensitive drum 15 which varies at every color and every development is measured by the toner image surface potential sensor 63. The charged surface potential Vs of the photosensitive drum 15 is measured every time and is stored in the potential difference calculation-use data memory 79. Based on the difference between the toner image surface potential Vt of the photosensitive drum 15 and the charged surface potential Vs, the CPU 71 controls the quantity of light projected onto the photosensitive drum 15 by the light projecting device 60. For example, the CPU 71 is capable of adjusting the quantity of light projected on the photosensitive drum 15 by the light projecting device 60, so that the charged surface potential Vs lowers so that the difference between the toner image surface potential Vt and the charged surface potential Vs becomes 0.

As a result, the image forming apparatus thus arranged is made capable of suppressing a rise of the potential of the transfer material P so as to stabilize the transfer electric field, irrelevant to changes of the charged surface potential Vs which occur as the photosensitive drum 15 ages, changes of the toner image surface potential Vt at every color and every development, and types of the transfer material. This results in prevention of scatter of the toner and the improvement of separation property, and as a result, improvement of image quality can be ensured.

On the other hand, usually, when a plurality of color toners are transferred to the transfer material P, the photosensitive drum 15 and the transfer material P repeatedly come into contact, causing the surface potential of the transfer material P to rise due to the background potential of the photosensitive drum 15.

In contrast, the CPU 71 of the image forming apparatus of the present embodiment is capable of controlling the quantity of light to be projected by the light projecting device 60 only in the case where a plurality of color toners are transferred onto the transfer material P.

Therefore, prior to an image forming operation with the use of a plurality of color toners, the CPU 71 adjusts the quantity of light projected on the photosensitive drum 15 by the light projecting device 60 based on the difference between the toner image surface potential Vt and the charged surface potential Vs, so that, for example, the charged surface potential Vs lowers so that the difference between the toner image surface potential Vt and the charged surface potential Vs becomes 0.

As a result, in the image forming operation with the use of a plurality of color toners, the image forming apparatus thus arranged is capable of surely stabilizing the transfer electric field and achieving an excellent image quality, irrelevant to changes of the charged surface potential Vs due to aging of the photosensitive drum 15, changes of the toner image surface potential Vt at every color and every development, and types of the transfer material P.

[Third Embodiment]

The following description will explain still another embodiment of the present invention, while referring to FIG. 18. The members having the same structure (function) as those in the above-mentioned embodiments will be designated by the same reference numerals and their description will be omitted.

In the first and second embodiments, the transfer unit 2 has the transfer drum 11, and a transfer operation is conducted with respect to the transfer material P at the transfer position X while the transfer material P adheres to the transfer drum 11. Besides, in the case of laminating transfer in which a plurality of color toner images are laminated, the transfer material P rotates while adhering to the transfer drum 11, and each color toner image is transferred to the transfer material P at the transfer position X so as to overlap each other.

However, in the present embodiment, the transfer unit 2 is provided with an intermediate transfer drum 80 as an intermediate transfer body, and the color toner images formed on the photosensitive drum 15 are sequentially transferred to the intermediate transfer drum 80 at the transfer position X, so as to overlap each other. When transfer of all the color toner images to the intermediate transfer drum 80 finishes, the laminated toner images thus obtained are transferred onto the transfer material P at a transfer position Y.

The intermediate transfer drum 80 has the same arrangement as that of the transfer drum 11 described above. Namely, like the transfer drum 11, the intermediate transfer drum 80 has a covering layer composed of a high-resistant material. Therefore, the intermediate transfer drum 80 can be formed by, for example, applying a high dielectric material such as polyvinylidene fluoride, silicon, or polyethylene terephthalate over a supporting body made of a conductive material such as aluminum.

Note that the intermediate transfer drum 80 is a drum in a cylindrical shape, but it is not necessarily as such. For example, an intermediate transfer belt may be used as the intermediate transfer body.

On the other hand, around the intermediate transfer drum 80, on an upstream side to a position where transfer of a toner image from the photosensitive drum 15 is carried out, there is provided a roller charger 81 for electrically charging the intermediate transfer drum 80. The roller charger 81 is grounded, or connected to a power source. A corona charger may be used, instead of the roller charger 81.

In addition, around the intermediate transfer drum 80, there is provided a paper feeding roller 82 for transporting the transfer material P and bringing it into contact with the intermediate transfer drum 80 at the transfer position Y. At the transfer position Y, all toner images laminated on the intermediate transfer drum 80 are transferred onto the transfer material P in a single step with application of a bias voltage to the intermediate transfer drum 80. Note that other than application of a bias voltage, charging from behind the transfer material P (from a side opposite to the intermediate transfer drum 80) may be carried out, or a roller may be used, for causing the transfer.

Around the intermediate transfer drum 80, there are further provided a cleaning device 11*b* for removing residual toner which adheres to the intermediate transfer drum 80, after transfer of a toner image onto the transfer material P, and a charge removing device 11*a* for removing residual charges in the dielectric layer of the intermediate transfer drum 80.

In the present embodiment as well, there is provided the light projecting device 40 for projecting light on a portion of the photosensitive drum 15 where transfer of an image thereon has not been conducted with respect to the intermediate transfer drum 80 while development has been conducted. The light projecting device 40 is arranged so as to operate in the same manner as those do in the first and second embodiments.

Therefore, the effect of the light projecting device 40 with respect to the intermediate transfer drum 80 is the same as that with respect to the transfer drum 11, since the intermediate transfer drum 80 is made of a high-resistant material as the transfer drum 11 is.

Thus, in the image forming apparatus of the present embodiment, a toner image of the photosensitive drum 15 is once transferred onto the intermediate transfer drum 80, and thereafter, it is transferred onto the transfer material P. Besides, in the case where a multi-color image is formed, each color toner image is discretely transferred onto the intermediate transfer drum 80 immediately after its formation, so that the color toner images thus transferred overlap each other. Then, when transfer of all the color toner images is completed, the color toner images thus laminated on the intermediate transfer drum 80 are all together transferred therefrom onto the transfer material P.

Incidentally, in the reversal development, a background potential of the photosensitive drum 15 is high even after development, and therefore a great transfer voltage is required. For this reason, the intermediate transfer drum 80 is necessarily required to have a great attracting force with respect to the transfer material P. As a result, when a toner image is being transferred from the intermediate transfer drum 80 with respect to the transfer material P, toners of the toner image come off and discharge electricity.

To avoid this, residual charges in the background portion of the photosensitive drum 15 may be removed by exposing the whole surface of the photosensitive drum 15, so that only a small transfer voltage is required and the efficiency of the transfer from the intermediate transfer drum 80 to the transfer material P is enhanced. However, if the background potential is unconditionally lowered before transfer, a toner image is caused to have a high potential, and scatter of toner occurs on the photosensitive drum 15 before transfer.

On the other hand, in the case where laminating transfer is carried out by the intermediate transfer drum 80 with the use of toners of various colors, a surface potential of the intermediate transfer drum 80 rises, affected by the background potential of the photosensitive drum 15 when the intermediate transfer drum 80 and the photosensitive drum 15 come into contact at every transfer. Therefore, as the transfer operation is repeated twice, three times, or the like in the laminating transfer, the effective transfer electric field gradually becomes smaller. Consequently, it is preferable that the rise of the surface potential of the intermediate transfer drum 80 due to the background potential should be suppressed.

Therefore, in the present embodiment, the light projecting device 40 is provided so as to project light on a portion of the photosensitive drum 15 on an upstream side to the toner image transfer position and on a downstream side to the portion subjected to the development process, and the light projecting operation of the light projecting device 40 is ON or OFF, depending on a type of toner.

Therefore, the background potential can be lowered with the toner image surface potential Vt maintained, by carrying out the light projecting operation of the light projecting device 40 only in the case of a color toner, which does not have great conductivity, or a black toner in which carbon accounts for a small part, or which is processed so as to be non-conductive even though carbon accounts for a large part in it.

As a result, the image forming apparatus thus arranged, which is provided with the intermediate transfer drum 80, is capable of, by appropriately controlling the background potential of the photosensitive drum 15, preventing scatter of the toner which tends to occur on light projection, preventing the lowering of the effective transfer electric field, improving the separation property, and therefore ensuring improvement of image quality.

Note that in the foregoing description, the present embodiment is explained by using as an example the arrangement wherein the light projecting device 40 is used as light projecting means, but the same effect as that of the second embodiment can be obtained with an arrangement wherein the light projecting device 60 of the second embodiment is provided so as to be controlled by the control unit 70 shown in FIG. 16.

Furthermore, even in the case where the intermediate transfer drum 80 is made of an inexpensive material, good transfer can be carried out. Therefore, the image forming apparatus can be provided at a low manufacturing cost.

The following description will explain more concrete examples in accordance with the embodiments of the present invention.

EXAMPLE 1

The following description will depict an experiment which was conducted in order to check performance of the image forming apparatus as described above in the first through third embodiments.

First of all, several types of usual toners for use in the reversal development were used. As a result, color toners using yellow, magenta, and cyan colorants for exclusive use in color toners and black toners using carbon black differed from each other in their behaviors.

To be more specific, an experiment was carried out on the usual black toner with a carbon quantity varied in a range of 5 percent by weight to 30 percent by weight. In any case, when the exposing operation for removing charges was performed, scatter of toner occurred around edges of a toner image composed of thin lines on the photosensitive drum 15 before the transfer process started.

In the case of the color toners, scatter of toner did not occur on the exposing operation for removing charges before transfer.

On the other hand, to remove charges from the photosensitive drum 15 by exposure, an LED input voltage of about 5 V was required as a voltage to be applied to the LED array 41 or 61, as illustrated in FIG. 17.

Besides, when a voltage of about 2 V was applied to the LED array 41 or 61, the charged surface potential Vs of the photosensitive drum 15 became substantially equal to the toner image surface potential Vt. Besides, no scatter of toner was observed even in the case where a toner in which carbon of 10 percent by weight was dispersed was used. Note that as a surface potential measure, TREK344 (trade name) produced by TREK INC. was used.

On the other hand, such a phenomenon has been observed not only in the reversal development but also in the regular development, and it has been observed also in the case where SHARP JX9210 (trade name) produced by Sharp Corp. is used as an image forming apparatus.

As to the color toner, scatter of toner tended to occur in the case where an agent such as silica was mixed in the color toner so that an electric resistivity measured by the volume resistivity measuring method shown in K6911 of the Japanese Industrial Standard would become about $10^{10}$ Ωcm.

Therefore, a desired transfer property could be obtained by previously predicting electric property of the toner, and based on the prediction, turning off the LED array 41 or 61 when the electric resistivity was at or below a certain level.

In measuring an electric resistivity by the volume resistivity measuring method, toner of 5 g was pressed so as to be 50 mm square in size was used.

EXAMPLE 2

In the case where a black toner in which many exposed carbon particles are dispersed was used, a phenomenon similar to scatter of toner was observed on the exposure by the LED array 41 or 61 with respect to the photosensitive drum 15.

In addition, it was found that in the case of the multi-color development, a desired transfer property without scatter was obtained by suspending the pre-transfer exposure by the LED array 41 or 61 only before the black toner was to be transferred.

EXAMPLE 3

As to (1) a toner having a low resistivity since carbon accounts for a large part in it or (2) a toner having a low resistivity since exposed carbon as conductive body is dispersed therein, which are mentioned in the examples 1 and 2, it is possible to process them so that they become non-conductive. Toners which have been thus processed behaved like the color toners, and any scatter as has conventionally occurred was not observed.

To be more specific, by mixing a toner charge control material in a black toner containing carbon of about 20 percent and styrene acryle (a copolymer of styrene and ester acrylate), scatter was suppressed.

In the case where it was necessary for carbon to account for about 30 percent so that the toner took color well, for example, PMMA (polymethyl methacrylate) of one percent by weight was put into the toner, and they were subjected to several thousands of rotations in a ball mill device so that they were mixed. As a result, a very thin film was formed on a surface of each particle of the toner. A bulk resistivity of the toner, which had been about $10^{10}$ Ωcm before the processing, was now about $10^{11}$ to $10^{12}$ Ωcm, that is, substantially equal to that of the color toner.

Note that the same results as those in the examples 1 through 3 wherein the laminating transfer was conducted with the transfer material P caught on the transfer drum 11 were also obtained in the case where the laminating transfer was conducted with respect to the intermediate transfer drum 80. These methods are commonly applicable to all image forming apparatuses of electrophotograpy for use in copying machines, laser beam printers, facsimile machines, and the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

an image carrier;

a developing unit for forming a toner image on said image carrier;

a transfer unit for transferring the toner image onto a transfer material;

a light projecting unit for projecting light on said image carrier after the toner image is formed thereon, before the transfer of the toner image;

a memory for pre-storing a plurality of predetermined toner types which are generally non-conductive;

an inputter for entering the type of toner used to form the toner image; and a control unit, responsive to said inputter, for accessing the memory to determine whether a toner used to form the toner image is one of the plurality of predetermined toners which are generally non-conductive so as to project light only for a generally non-conductive toner, wherein the light projection unit executes and suspends the projection of light based on the determination by said control unit.

2. The image forming apparatus as set forth in claim 1, further comprising a memory in which data on various types of toners are stored in advance, wherein said control unit uses data stored in said memory, in judging the type of toner.

3. The image forming apparatus as set forth in claim 1, wherein, in the case where the toner is a color toner, said control unit causes said light projecting unit to project light onto said image carrier.

4. The image forming apparatus as set forth in claim 1, further comprising:

toner image surface potential measuring means for measuring a toner image surface potential which is a surface potential of said image carrier in a state where the toner image is formed thereon;

storing means for storing a charged surface potential of said image carrier; and projected light quantity controlling means for controlling a quantity of light projected onto said image carrier by said light projecting unit, based on a difference between the toner image surface potential and the charged surface potential.

5. The image forming apparatus as set forth in claim 4, wherein in the case where the toner image is formed with a plurality of color toners, said projected light quantity controlling means varies a quantity of the light projected by the light projecting unit so as to project an appropriate quantity of light for each color toner.

6. The image forming apparatus as set forth in claim 1, wherein said transfer unit includes an intermediate transfer body for transfer the toner image onto the transfer material.

7. The image forming apparatus as set forth in claim 1, wherein said transfer unit includes a transfer material carrier for electrostatically attracting and holding the transfer material and guiding it to said image carrier.

8. The image forming apparatus as set forth in claim 7, further comprising charging means, provided in contact with said transfer material carrier, for charging it.

9. The image forming apparatus as set forth in claim 7, wherein:

said transfer material carrier has on its surface a conductive layer, a semi-conductive layer, and a dielectric layer which are laminated in this order; and the dielectric layer is formed wider than the semi-conductive layer so that the semi-conductive layer does not come into contact with said image carrier.

10. The image forming apparatus as set forth in claim 1, further comprising a shielding member for preventing the light projected by said light projecting unit from intruding in said developing unit, said shielding member being provided between said light projecting unit and said developing unit.

11. The image forming apparatus as set forth in claim 1, further comprising an optical path regulating member for converging the light from said light projecting unit only on said image carrier.

12. The image forming apparatus as set forth in claim 1, wherein a light-emitting surface of said light projecting unit is positioned on a side to said image carrier with respect to a tangent line of said image carrier which orthogonally crosses a line connecting a center of said image carrier and a center of a sleeve of said developing unit.

13. The image forming apparatus as set forth in claim 1, further comprising:

transfer material detecting means for judging a type of the transfer material; and nip period control means for adjusting a nip period in accordance with the type of the transfer material.

14. The image forming apparatus as set forth in claim 1, wherein said control unit determines if the toner is one of said plurality of predetermined toners based on whether an electric resistivity of the toner is not more than a predetermined value.

15. The image forming apparatus as set forth in claim 1, wherein said control unit identifies a toner to be used in accordance with an instruction of a printing mode indicating a color type including black.

16. An image forming apparatus, comprising:

an image carrier;

a developing unit for forming a toner image on said image carrier;

a transfer unit for transferring the toner image onto a transfer material;

a light projecting unit for projecting light on said image carrier after the toner image is formed thereon, before the transfer of the toner image;

an inputter for entering the type of toner used to form the toner image; and a control unit, responsive to said inputter, for determining whether a toner used to form the toner image is one of a plurality of pre-stored predetermined toners, which are generally non-conductive, by comparing the toner with the plurality of pre-stored predetermined toners, and for executing the light projecting operation by the light projecting unit only when the toner is determined from the comparison to be generally non-conductive.

17. A method for operating an image forming apparatus, comprising the steps of:

forming a toner image on an image carrier;

transferring the toner image onto a transferred material;

projecting light on the image carrier after the toner image is formed thereon and before the transfer of the toner image;

pre-storing a plurality of predetermined toners which are generally non-conductive;

entering a type of toner used to form the toner image;

determining if the toner used to form the toner image is one of the plurality of predetermined toners by a comparison with the pre-stored plurality of toners; and executing and suspending the projection of light based on the determination, so as to project light only for a generally non-conductive toner.

18. An image forming apparatus, comprising:

an image carrier;

a developing unit for forming a toner image on said image carrier;

a transfer unit for transferring the toner image onto a transfer material;

a light projecting unit for projecting light on said image carrier after the toner image is formed thereon, before the transfer of the toner image;

a memory for pre-storing a plurality of predetermined toner types which are generally non-conductive;

an inputter for entering the type of toner used to form the toner image; and a control unit, responsive to said inputter, for controlling the light projection unit by determining if the type of toner used is one of said plurality of predetermined toner types, wherein, upon the toner type being determined to be a colorant of a generally non-conductive type, said control unit causes said light projecting unit to project light onto said image carrier.

* * * * *